US010535321B2

(12) United States Patent
Yang

(10) Patent No.: US 10,535,321 B2
(45) Date of Patent: Jan. 14, 2020

(54) DISPLAY PANEL, DISPLAY DEVICE AND DRIVING METHOD OF DISPLAY PANEL

(71) Applicant: Xiamen Tianma Micro-Electronics Co., Ltd., Xiamen (CN)

(72) Inventor: Wenbin Yang, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 16/015,762

(22) Filed: Jun. 22, 2018

(65) Prior Publication Data

US 2019/0251930 A1 Aug. 15, 2019

(30) Foreign Application Priority Data

Feb. 12, 2018 (CN) ..... 2018 1 0145666

(51) Int. Cl.
*G09G 3/36* (2006.01)
*G09G 5/10* (2006.01)
*G09G 3/32* (2016.01)

(52) U.S. Cl.
CPC ..... *G09G 5/10* (2013.01); *G09G 3/32* (2013.01); *G09G 2300/08* (2013.01); *G09G 2330/021* (2013.01)

(58) Field of Classification Search
CPC ..... G09G 3/3614; G09G 2320/043; G09G 2300/0809; G09G 2320/0233; G09G 2330/021; G09G 3/296; G09G 3/3266; G09G 3/3611; G09G 2320/045; G09G 2310/0283; G09G 2300/0823; G09G 2310/0248; G09G 2320/0252; G09G 2310/0254; G09G 2310/0275; G09G 5/10; G09G 2300/08; G09G 2320/0247; G09G 2360/04; G09G 2310/062; G09G 2300/046; G09G 2300/0842; G09G 2310/0251; G09G 3/3225; G09G 2310/0218; G09G 3/2932;
(Continued)

(56) References Cited

U.S. PATENT DOCUMENTS 7,505,053 B2 * 3/2009 Brown Elliott ... G02F 1/133514 345/694
8,199,102 B2 * 6/2012 Lee ..... G09G 3/3688 345/100

FOREIGN PATENT DOCUMENTS

CN 1956048 A 5/2007
CN 105654916 A 6/2016

* cited by examiner

*Primary Examiner* — Duc Q Dinh
(74) *Attorney, Agent, or Firm* — Tarolli, Sundheim, Covell & Tummino LLP

(57) ABSTRACT

The present disclosure provides a display panel, a display device and a driving method of a display panel, aiming to lower power consumption of display devices. The display panel operates in P pixel charging sub-phases, and P is a number of rows of pixels. Every two sequential pixel charging sub-phases form one pixel charging phase. In one pixel charging sub-phase of each pixel charging phase, switch group elements of each driving unit are switched on in a first sequence, and in the other pixel charging sub-phase of each pixel charging phase, the switch group elements of each driving unit are switched on in a second sequence. The first sequence and the second sequence are reversed. In the present disclosure, 1≤P, 1≤N, and P and N are positive integers. The above display panel is applicable to display devices.

18 Claims, 11 Drawing Sheets

(58) Field of Classification Search
CPC ..... G09G 2310/027; G09G 3/006; G09G 3/3275; G09G 5/346
USPC ..... 345/87, 98–100
See application file for complete search history.

DISPLAY PANEL, DISPLAY DEVICE AND DRIVING METHOD OF DISPLAY PANEL

CROSS-REFERENCE TO RELATED APPLICATIONS

The present application claims priority to Chinese Patent Application No. CN201810145666.4, filed on Feb. 12, 2018, the content of which is incorporated herein by reference in its entirety.

TECHNICAL FIELD

The present application relates to the field of display technology, and particularly, to a display panel, a display device and a driving method of a display panel.

BACKGROUND

With the development of science and technology, display devices with display panels are widely used, so that the display devices have increasingly close relation with the daily life and work of the public.

A display device integrates functions such as display, touch control, and force-sensitive control. The power consumption of the display device also increases with an increasing integration of the display device.

A major technical problem currently facing is how to reduce the power consumption of display devices.

SUMMARY

The present disclosure provides a display panel, a display device and a driving method of a display panel, aiming to lower power consumption of display devices.

A first aspect of the present disclosure provides a display panel. The display panel includes: N data line units, each of the N data line units including at least four data lines; and N pixel units corresponding to the N data lines arranged in each row. Each of the N pixel units includes at least four types of pixels having different emitting-light colors. One of the at least four types of pixels having different emitting-light colors includes a white pixel. N pixel units corresponding to the N data line units are arranged in each row. At least four types of pixels having different emitting-light colors in each of the N pixel units correspond to at least four data lines in a corresponding data line unit in one-to-one correspondence. Pixels in a same column are electrically connected to a same data line. The display panel further includes N driving units electrically connected to the N data line units in one-to-one correspondence; and N data output terminals electrically connected to the N driving units in one-to-one correspondence. Each of the N driving units includes at least four switch group elements corresponding to the at least four data lines in each of the N data line units in one-to-one correspondence. Each switch group element of each of the N driving units has a first terminal electrically connected to a corresponding data line and a second terminal electrically connected to a corresponding data output terminal. The display panel operates in P pixel charging sub-phases, P is a number of rows of pixels, every two sequential pixel charging sub-phases form one pixel charging phase of the P pixel charging sub-phase; in one pixel charging sub-phase of each pixel charging phase, at least four switch group elements of each of the N driving units are switched on in a first sequence; in the other pixel charging sub-phase of each pixel charging phase, at least four switch group elements of each of the N driving units are switched on in a second sequence; and the first sequence and the second sequence are reversed. $1 \leq P$, $1 \leq N$, and P and N are positive integers.

A second aspect of the present disclosure provides a display device including the display panel according to the first aspect of the present disclosure.

A third aspect of the present disclosure provides a driving method of the display panel according the first aspect of the present disclosure. The driving method of the display panel includes: in one pixel charging sub-phase of the P pixel charging sub-phases, sequentially switching on the at least four switch group elements of each of the N driving units in the first sequence, and sequentially transmitting data signals output by the N data output terminals to corresponding pixels, and in another pixel charging sub-phase of the P pixel charging sub-phases, sequentially switching on the at least four switch group elements of each of the N driving units in the second sequence, and sequentially transmitting the data signals output by the N data output terminals to corresponding pixels.

These aspects mentioned above and any possible embodiment can achieve following beneficial effects.

In one pixel charging sub-phase of each pixel charging phase, the switch group elements in the driving unit are sequentially switched on in the first sequence. In the other pixel charging sub-phase of each pixel charging phase, the switch group elements in the driving unit are sequentially switched on in the second sequence. It can be concluded that, in one pixel charging phase, the enable signal received by the switch group element corresponding to a firstly-charged column of pixels changes every eight time periods, and the enable signal received by the switch group element corresponding to a last-charged column of pixels also changes every eight time periods. In the related art, the enable signal received by the switch group element changes at least every four time periods, i.e., the enable signal received by the switch group element has a cycle of T. However, in the present disclosure, the enable signal received by the switch group element corresponding to the firstly-charged column of pixels and the enable signal received by the switch group element corresponding to the last-charged column of pixels both have a cycle of at least 2T. When the power consumption of the switch group element each time receiving the enable signal is constant, compared with the related art, the present disclosure can effectively reduce the power consumption due to the longer cycle of the enable signals received by the switch group elements corresponding to the firstly-charged column of pixels and the last-charged column of pixels. In addition, when the battery capacity in the display device is constant, the standby time of the display device can become longer due to the lower power consumption of the present embodiment.

BRIEF DESCRIPTION OF DRAWINGS

In order to more clearly illustrate technical solutions of the related art and embodiments of the present disclosure, the accompanying drawings used in description of the embodiments and the related art are briefly described below. The drawings described below are merely a part of the embodiments of the present disclosure. Based on these drawings, those skilled in the art can obtain other drawings without any creative effort.

DESCRIPTION OF EMBODIMENTS

Figure 1:
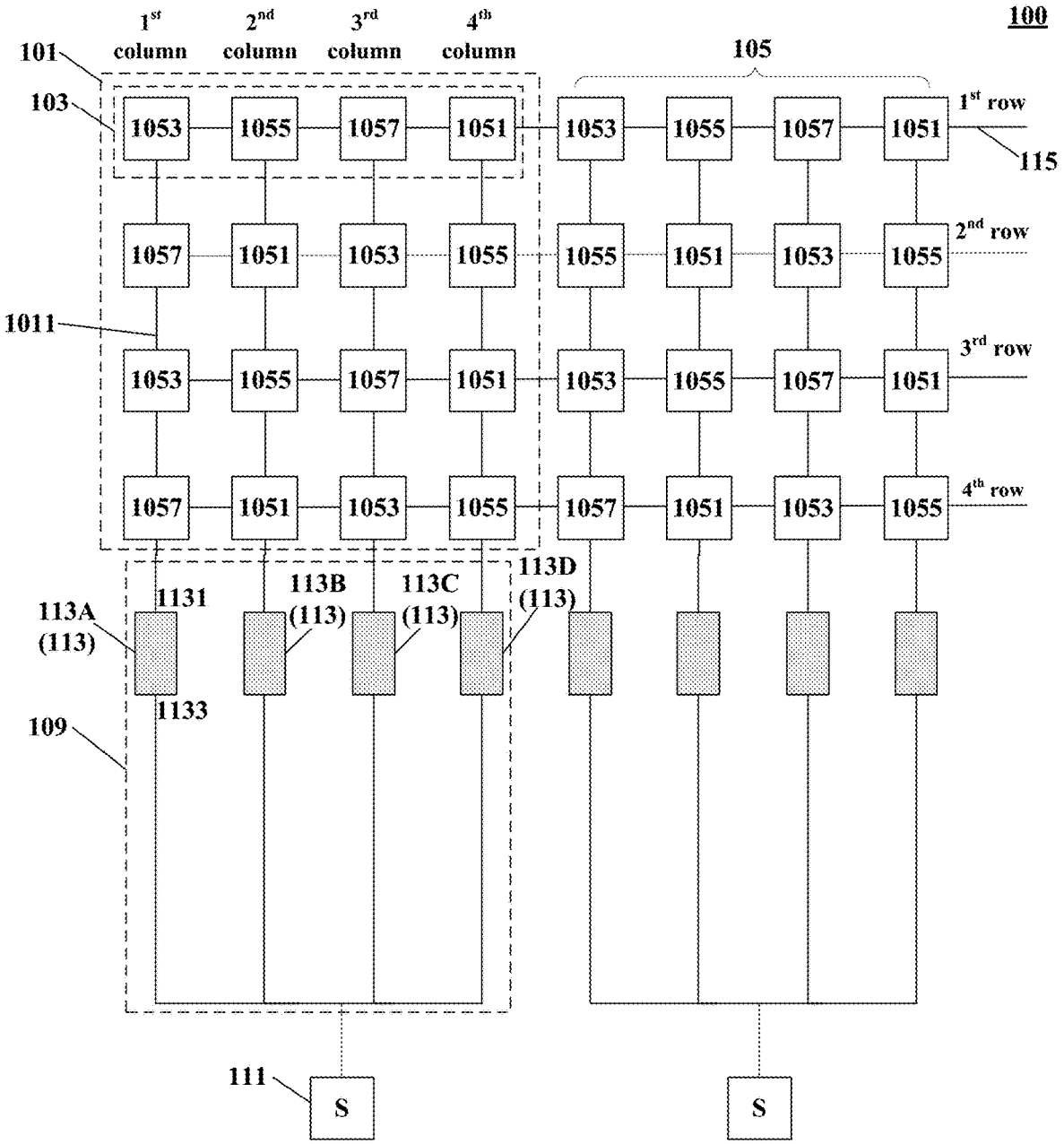
FIG. 1 is a structural schematic diagram of a display panel according to an embodiment of the present disclosure.

For a better understanding of the technical solutions of the present disclosure, the embodiments of the present disclosure are hereinafter described in details with reference to the drawings. The described embodiments are only a part of the embodiments, rather than all of the embodiments of the present disclosure. On basis of the embodiments in the present disclosure, any other embodiments obtained by a person skilled in the art without involving any inventive skills falls within the protection scope of the present disclosure.

The terms used in the embodiments of the present disclosure are only used for the purpose of describing particular embodiments and do not intend to limit the present disclosure. The words "a/an", "said" and "the" in the singular form used in the embodiments and the appended Claims of the present disclosure also intend to include the plural form, unless otherwise clearly indicated in the context.

It should be understood that the term "and/or" used in the text only indicates a related relation describing related objects and indicates that there may be three relations, for example A and/or B may indicates three conditions of: A only, both A and B, and B only. Furthermore, the character "/" in the text generally indicates an "or" relation of the previous and following related objects.

It should be understood that the embodiments of the present disclosure may use the terms "first", "second", "third", etc. to describe thin film transistors, these thin film transistors, however, should not be limited by these terms. These terms are only used for distinguishing the thin film transistors from each other. For example, without departing from the scope of the embodiments of the present disclosure, a first thin film transistor may also be referred to as a second thin film transistor, and similarly, a second thin film transistor may also be referred to as a first thin film transistor.

It should be understood that words for describing locations and position in the embodiments of the present disclosure, such as "upper", "lower", "left" and "right", are used in perspective of the drawings, and should not be construed as any limitation of the embodiments of the present disclosure. In addition, in the context, when referring to an element being formed "on" or "under" another element, it means that the element can be formed not only directly "on" or "under" the other element, but also indirectly "on" or "under" the other element through an intermediate element.

Currently, a display panel includes a plurality of gate lines extending in a row direction and a plurality of data lines extending in a column direction. The gate lines are intersected with the data lines to define a plurality of pixels. The gate lines electrically connected to rows of pixels in one-to-one correspondence receive scanning signals sequentially. When one of the gate lines is scanned, a data signal output by a driving chip is transmitted through a data line to a row of pixels corresponding to this gate line. The number of terminals of the driving chip is limited. In order to reduce the number of ports of the driving chip, it is necessary to divide the data lines into groups through a demultiplexing circuit (hereinafter referred to as Demux) and to transmit the data signal to the corresponding pixels in time-division in cooperation with clock signal lines.

In this case, assuming that the number of the clock signal lines is four and enable signals are sequentially provided to the four clock signal lines, the data signals from the corresponding data output terminals are transmitted to the corresponding pixels. At this time, the enable signal provided on the same clock signal line changes every four time periods, and each change of the enable signal provided on the clock signal line indicates one cycle T. In other words, an enable signal provided by each clock signal line has a cycle of T, and thus an enable signal received by a switch group element corresponding to each clock signal line has a cycle of T. One time period can be understood as a duration or a width of a waveform of an enable signal of one clock signal line.

Each time when one of the gates lines is scanned, it is needed to charge one row of pixels corresponding to this gate line. Assuming that ten gate lines are to be scanned, i.e., ten rows of pixels are to be charged, each clock signal line should be turned on ten times. The more frequently the clock signal lines are turned on, the more power the clock signal lines consume. Endurance of the battery will also be affected.

In order to solve the above problems, the following technical solutions have been proposed.

The present disclosure provides a display panel 100, as shown in FIG. 1, which is a schematic structural diagram of a display panel provided by an embodiment of the present disclosure. The display panel 100 includes N data line units 101, each of which includes at least four data lines 1011, where $1 \leq N$, and N is a positive integer.

The display panel 100 further includes at least four types of pixels 105 having different emitting-light colors. One of the at least four types of pixels 105 having different emitting-light colors is a white pixel 1051. It should be understood that the at least four types of pixels 105 having different emitting-light colors can be arranged in various manners. To clearly describe the present embodiment, FIG. 1 shows an exemplary arrangement manner, and four types of pixels having different emitting-light colors include a first color pixel 1053, a second color pixel 1055, a third color pixel 1057, and a white pixel 1051. At least four pixels of different colors that are adjacent in each row constitute a pixel unit 103. That is, each pixel unit 103 includes a first color pixel 1053, a second color pixel 1055, a third color pixel 1057, and a white pixel 1051. In each pixel unit 103, the at least four types of pixels 105 having different emitting-light colors correspond to at least four data lines 1011 in a corresponding data line unit 101 in one-to-one correspondence, and pixels in a same column are electrically connected to a same data line 1011.

The display panel 100 further includes N driving units 109 electrically connected to the N data line units 101 in one-to-one correspondence, and N data output terminals 111 electrically connected to the N driving units 109.

Each driving unit 109 includes at least four switch group elements 113 corresponding to the at least four data lines 1011 in each data line unit 101 in one-to-one correspondence. In each driving unit 109, a first terminal 1131 of each switch group element is electrically connected to a corresponding data line 1011, and a second terminal 1133 of each switch group element is electrically connected to a corresponding data output terminal 111. For example, as shown in FIG. 1, in order to clearly explain the connection relationship of the present embodiment, the four switch group elements in the driving unit 109 are numbered. As shown in FIG. 1, the switch group elements sequentially arranged from left to right are a switch group element 113A, a switch group element 113B, a switch group element 113C, and a switch group element 113D.

The display panel 100 operates in P pixel charging sub-phases. P is the number of rows of pixels, where $1 \leq P$, and P is a positive integer. In other words, each pixel charging sub-phase corresponds to one row of pixels, and every two sequential pixel charging sub-phases form one pixel charging phase. Illustratively, as shown in FIG. 1, each of a first row and a second row corresponds to a pixel charging sub-phase, and the pixel charging sub-phase to which the first row corresponds and the pixel charging sub-phase to which the second row corresponds constitute one pixel charging phase. The pixel charging sub-phase is understood as follows. As shown in FIG. 1, the display panel 100 further includes P gate lines 115 electrically connected to the P rows of pixels in one-to-one correspondence. The P gate lines 115 needs to receive scanning signals row by row. When any one of the gate lines 115 is scanned, a row of pixels corresponding to this gate line 115 receives a data signal output by the data output terminal, and this time period can be referred to as one pixel charging sub-phase.

In one pixel charging sub-phase of each pixel charging phase, M switch group elements 113 of each driving unit 109 are sequentially switched on in a first sequence. In the other pixel charging sub-phase of each pixel charging phase, the switch group elements 113 of each driving unit 109 are sequentially switched on in a second sequence. The first sequence and the second sequence are reversed. Taking the orientation shown in FIG. 1 as a reference, "the first sequence" in this embodiment can be understood as a direction from left to right, i.e., the switch group element 113A, the switch group element 113B, the switch group element 113C and the switch group element 113D are sequentially switched on; the second sequence can be understood as a direction from right to left, i.e., the switch group element 113D, the switch group element 113C, the switch group element 113B and the switch group element 113A are sequentially switched on. Alternatively, "the first sequence" can be understood as a direction from right to left, and the second sequence can be understood as a direction from left to right, as long as the two sequences are reversed.

With reference to the structure of the display panel shown in FIG. 1, the embodiments of the present disclosure also provides a driving method of a display panel. The driving method is applicable to the above display panel 100.

Figure 2:
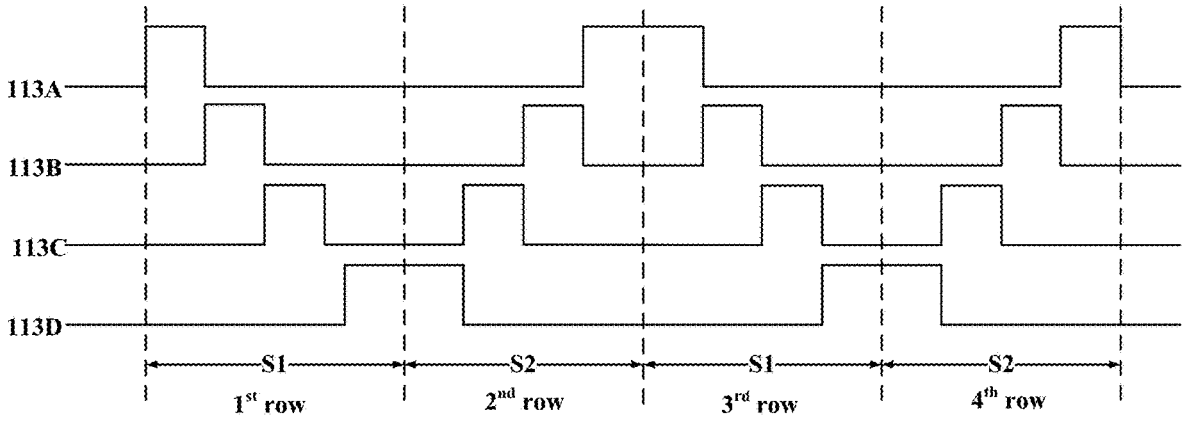
FIG. 2 is a sequence diagram of a display panel according to an embodiment of the present disclosure.

FIG. 2 is a sequence diagram of a display panel provided by an embodiment of the present disclosure. The driving method of the display panel includes: in a pixel charging sub-phase S1, sequentially switching on the switch group elements in the first sequence, and sequentially transmitting the data signals at the data output terminals to the corresponding pixels; and in the other pixel charging sub-phase S2, sequentially switching on the switch group elements in the second sequence, and sequentially transmitting the data signals at the data output terminals to the corresponding pixels.

In the following, the pixel charging phase according to the present embodiment will be described in detail with reference to FIG. 1 and the sequence diagrams shown in FIG. 2.

The embodiment shown in FIG. 2 can be understood as a row-by-row scanning, that is, the first gate line electrically connected to the first row of pixels, the second gate line electrically connected to the second row of pixels, the third gate line electrically connected to the third row of pixels, and the fourth gate line electrically connected to the fourth row of pixels are sequentially scanned. In one pixel charging phase, the scanning of the first gate line electrically connected to the first row of pixels corresponds to a pixel charging sub-phase S1, and the scanning of the second gate line electrically connected to the second row of pixels corresponds to a pixel charging sub-phase S2. In the next pixel charging phase, the scanning of the third gate line electrically connected to the third row of pixels corresponds to a pixel charging sub-phase S1, and the scanning of the fourth gate line electrically connected to the fourth row of pixels corresponds to a pixel charging sub-phase S2. In the time period of scanning the first gate line electrically connected to the first row of pixels, the switch group element 113A corresponding to the first column of pixels, the switch group element 113B corresponding to the second column of pixels, the switch group element 113C corresponding to the third column of pixels and the switch group element 113D corresponding to the fourth column of pixels are sequentially switched on in the first sequence; and the pixel 1053 where the first row and the first column intersect with one another, the pixel 1055 where the first row and the second column intersect with one another, the pixel 1057 where the first row and the third column intersect with one another, and the pixel 1051 where the first row and the fourth column intersect with one another sequentially receive the data signal output by data output terminal 111, thereby completing the scanning of the first gate line electrically connected to the first row of pixels, i.e., completing the pixel charging sub-phase S1. In the time period of scanning the second gate line electrically connected to the second row of pixels, the switch group element 113D corresponding to the fourth column of pixels, the switch group element 113C corresponding to the third column of pixels, the switch group element 113B corresponding to the second column of pixels and the switch group element 113A corresponding to the first column of pixels are sequentially switched on in the second sequence; and the pixel 1055 where the second row and the fourth column intersect with one another, the pixel 1053 where the second row and the third column intersect with one another, the pixel 1051 where the second row and the second column intersect with one another and the pixel 1057 where the second row and the first column intersect with one another sequentially receive the data signal output by the data output terminal 111, thereby completing the scanning of the second gate line electrically connected to the second row of pixels, i.e., completing the pixel charging sub-phase S2. The rest can be done in the same manner, so as to complete the scanning of the entire display panel. Since a row consists of several repeated pixel units 103, merely one pixel unit 103 is described above as an example. The pixel charging processes of other pixel units 103 can refer to the above description, which will not be described herein again.

In the related art, after Demux is determined, for example, one input line is electrically connected to four output lines (1:4) and the four output lines output signals in time-division. In this case, an enable signal received by a same switch group element changes every four time periods. That is, the cycle of the enable signal received by the switch group element is T.

In this embodiment, as can be clearly seen in FIG. 2, in the pixel charging sub-phase S1 of each pixel charging phase, the switch group elements 113 in the driving unit 109 are sequentially switched on in the first sequence; and in the other pixel charging sub-phase S2 of each pixel charging phase, the switch group elements 113 in the driving unit 109 are sequentially switched on in the second sequence. It can be concluded that, in one pixel charging phase, an enable signal received by a switch group element corresponding to a firstly-charged column of pixels (the first column of pixels) changes every eight time periods, and an enable signal received by a switch group element corresponding to a last-charged column of pixels also changes every eight time periods. That is, the enable signal received by the switch group element corresponding to the firstly-charged column of pixels and the enable signal received by the switch group element corresponding to the last-charged column of pixels both have a cycle of 2T. When the power consumed by the switch group element each time receiving the enable signal is constant, compared with the related art, the present embodiment can effectively reduce the power consumption due to the longer cycle of the enable signals received by the switch group elements corresponding to the firstly-charged column of pixels and the last-charged column of pixels. In addition, when the battery capacity in the display device is fixed, the standby time of the display device can become longer due to the lower power consumption of the present embodiment.

It should be understood that each pixel unit in this embodiment includes four columns of pixels. In fact, this embodiment is not intended to specifically limit the number of pixels included in each pixel unit. When each pixel unit includes four columns of pixels, the enable signal received by each switch group element changes every four time periods. When each pixel unit includes five columns of pixels, the enable signal received by each switch group element changes every five time periods. Inevitably, regardless of the number of pixels included in each pixel unit, in the implementation manner according to the present embodiment, the cycle of the enable signal received by the switch group element corresponding to at least two columns of pixels is 2T, which is the double of the cycle of the enable signal received by the switch group element under a similar construction in the related art.

FIG. 1 merely illustrates a structure with N=2 and P=2. In fact, the number of rows of pixels, P, according to the present disclosure is much greater than 4, N is also much larger than 2, and specific values thereof can be determined according to the specific products. In addition, FIG. 2 and the following drawings also exemplarily show a part of pixel units, driving units, and data line units in the display panel. The specific values thereof can also be determined according to the specific products. The embodiments do not specifically limit the values. In this embodiment, the data output terminals 111 can be understood as ports of the driving chip, i.e., the driving chip provides data signals for each pixel, so to achieve the charging of the pixels.

According to the display panel shown in FIG. 1, several specific operating methods will be described below.

In an embodiment, referring to FIG. 2, the display panel 100 further includes P gate lines 115 electrically connected to P rows of pixels in one-to-one correspondence. The P gate lines 115 sequentially receive the scanning signals. When one gate line 115 is scanned, a row of pixels corresponding to this gate line 115 receives the data signal output by the data output terminal 111. During displaying of one frame of the display panel 100, pixels in an $i^{th}$ row receiving data signals output by the data output terminals corresponds to an $i^{th}$ pixel charging sub-phase of P pixel charging sub-phases, where i can be 1, 2, 3, . . . , or P. In the embodiment shown in FIG. 1, P=2, and i can be 1 or 2. In this embodiment, the P gate lines corresponding to the P rows of pixels are scanned row-by-row, and the specific driving method can refer to the above related description. In this embodiment, in one pixel charging phase, the enable signal received by the switch group element corresponding to a firstly-charged column of pixels changes every eight time periods, and the enable signal received by the switch group element corresponding to a last-charged column of pixels also changes every eight time periods. That is, the enable signal received by the switch group element corresponding to the firstly-charged column of pixels and the enable signal received by the switch group element corresponding to the last-charged column of pixels both have a cycle of 2T. When the power consumed by the switch group element each time receiving the enable signal is constant, compared with the related art, the present embodiment can effectively reduce the power consumption due to the longer cycle of the enable signals received by the switch group elements corresponding to the firstly-charged column of pixels and the last-charged column of pixels. In addition, when the battery capacity in the display device is fixed, the standby time of the display device can become longer due to the lower power consumption of the present embodiment.

Figure 3:
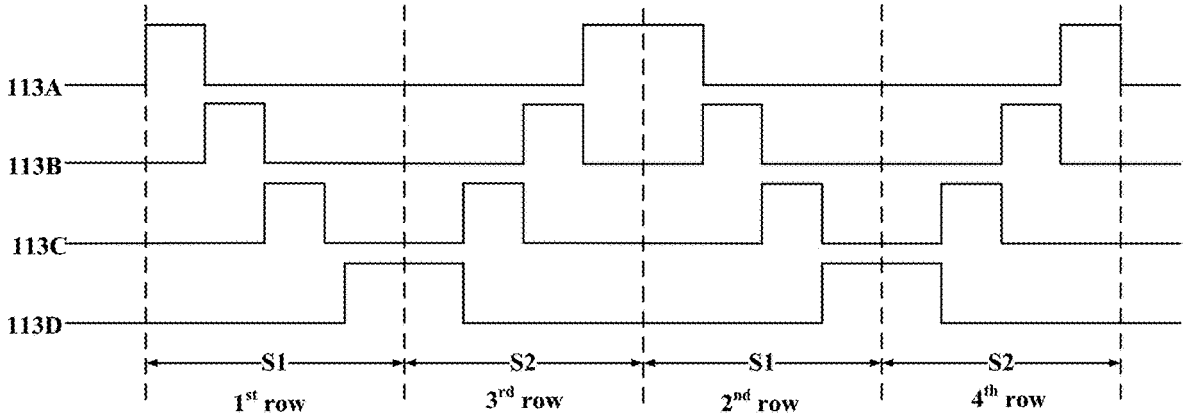
FIG. 3 is another sequence diagram of a display panel according to an embodiment of the present disclosure.

In another embodiment, as shown in FIG. 3, which illustrates another sequence diagram of a display panel according to an embodiment of the present disclosure, the display panel 100 further includes P gate lines 115 electrically connected to P rows of pixels in one-to-one correspondence. The P gate lines 115 receive the scanning signals. When one gate line 115 is scanned, a row of pixels corresponding to this gate line 115 receives the data signal output by the data output terminal. During the displaying of one frame of the display panel 100, pixels in a $(2i-1)^{th}$ row receiving the data signals output by the data output terminals corresponds to an $i^{th}$ pixel charging sub-phase of P pixel charging sub-phases, where i can be 1, 2, 3, or P/2, and P is an even number. In the display panel 100 shown in FIG. 1, P=4, and i can be 1 or 2. Pixels in a $(2j-1)^{th}$ row receiving the data signals output by the data output terminals corresponds to a $(P/2+j)^{th}$ pixel charging sub-phase of P pixel charging sub-phases, where j can be 1, 2, 3, . . . , or P/2, and P is an even number. In the embodiment shown in FIG. 1, P=4, and j can be 1 or 2.

Referring FIG. 1 and FIG. 3, a driving method of the display panel according to the present embodiment will be described as follows.

In the present embodiment, during the displaying of one frame, gate lines electrically connected to the odd-numbered rows of pixels are firstly scanned, i.e., the first gate line electrically connected to the first row of pixels and the third gate line electrically connected to the third row of pixels are firstly scanned. At this time, in one pixel charging phase, the scanning of the gate line corresponding to the first row of pixels corresponds to an anterior pixel charging sub-phase S1, and the scanning of the gate line corresponding to the third row of pixels corresponds to a posterior pixel charging sub-phase S2. Then, the gate lines electrically connected to the even-numbered rows of pixels are secondly scanned, i.e., the second gate line electrically connected to the second row of pixels and the fourth gate line electrically connected the fourth row of pixels are scanned. At this time, in one pixel charging phase, the scanning of the gate line corresponding to the second row of pixels corresponds to the anterior pixel charging sub-phase S1, and the scanning of the gate line corresponding to the fourth row of pixels corresponds to the posterior pixel charging sub-phase S2. Specifically, in the time period of scanning the first gate line electrically connected to the first row of pixels, in each driving unit 109, the switch group element 113A electrically connected to a first color pixel 1053, the switch group element 113B electrically connected to a second color pixel 1055, the switch group element 113C electrically connected to a third color pixel 1057, and the switch group element 113D electrically connected to a white pixel 1051 are sequentially switched on in the first sequence, and the data signals output by the corresponding date output terminals 111 are transmitted to the corresponding pixels, thereby completing the scanning of the first gate line electrically connected to the first row of pixels. Then, in the time period of scanning the third gate line electrically connected to the third row of pixels, in each driving unit 109, the switch group element 113D electrically connected to a white pixel 1051, the switch group element 113C electrically connected to a third color pixel 1057, the switch group element 113B electrically connected to a second color pixel 1055, and the switch group element 113A electrically connected to a first color pixel 1053 are sequentially switched on in the second sequence, and the data signals output by the corresponding date output terminals 111 are transmitted to the corresponding pixels, thereby completing the scanning of the third gate line electrically connected to the third row of pixels. The scanning of the second gate line electrically connected to the second row of pixels and the scanning of the fourth gate line electrically connected to the fourth row of pixels are completed in similar manners as the above-described scanning of the first gate line electrically connected to the first row of pixels and the above-described scanning of the third gate line electrically connected to the third row of pixels, and will not be repeated here It can be seem from the sequence diagram of FIG. 3 in combination with the arrangement of the pixels shown in FIG. 1 that the color of the last-charged pixel in the anterior pixel charging sub-phase S1 is the same as the color of the firstly-charged pixel in the posterior pixel charging sub-phase S2. The pixels having the same color have a same charging time or a charging voltage, and both are connected to a same switch group element. Therefore, the waveform of the enable signal received by the switch group element does not vary, thereby simplifying the operating process of the driving chip.

Figure 4:
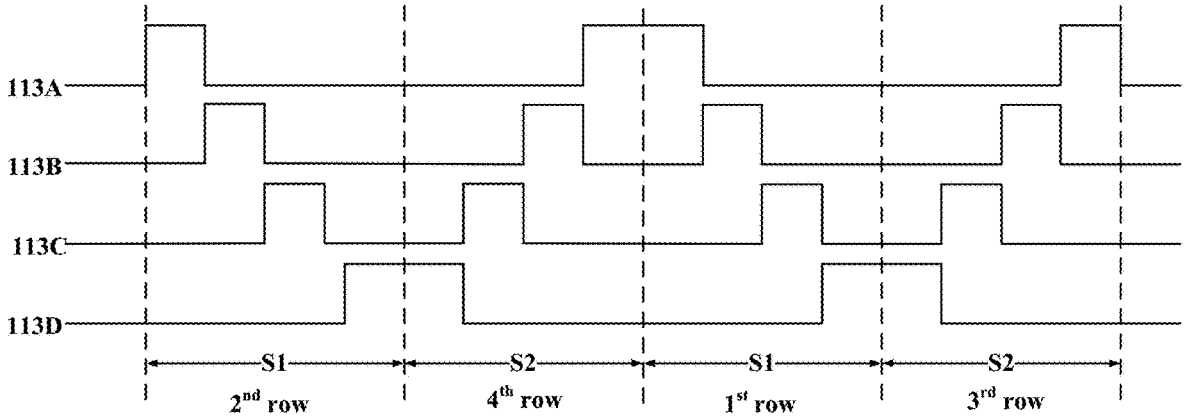
FIG. 4 is another sequence diagram of a display panel according to an embodiment of the present disclosure.

In another embodiment, it is also possible to scan the gate lines electrically connected to the even-numbered rows of pixels firstly, and then scan the gate lines electrically connected to the odd-numbered rows of pixels. Specifically, as shown in FIG. 4, which illustrates another sequence diagram of a display panel according to an embodiment of the present disclosure, the display panel 100 further includes P gate lines 115 electrically connected to P rows of pixels in one-to-one correspondence. The P gate lines 115 receive the scanning signals. When one gate line 115 is scanned, pixels in a row corresponding to this gate line 115 receive the data signals output by the data output terminal 111. During the displaying of one frame of the display panel 100, pixels in a $2i^{th}$ row receiving the data signals output by the data output terminal corresponds to an $i^{th}$ pixel charging sub-phase of P pixel charging sub-phases, where i can be 1, 2, 3, . . . , or P/2. Referring to FIG. 1, P=4, and i can be 1 or 2. Pixels in a $(2j-1)^{th}$ row receiving the data signals output by the data output terminal corresponds to a $(P/2+j)^{th}$ pixel charging sub-phase of P pixel charging sub-phases, where j can be 1, 2, 3, . . . , or P/2, and P is an even number. Referring to FIG. 1, P=4, and j can be 1 or 2. The specific operating manner and beneficial effects can refer to the embodiment shown in FIG. 3, which will not be described herein again.

Figure 5:
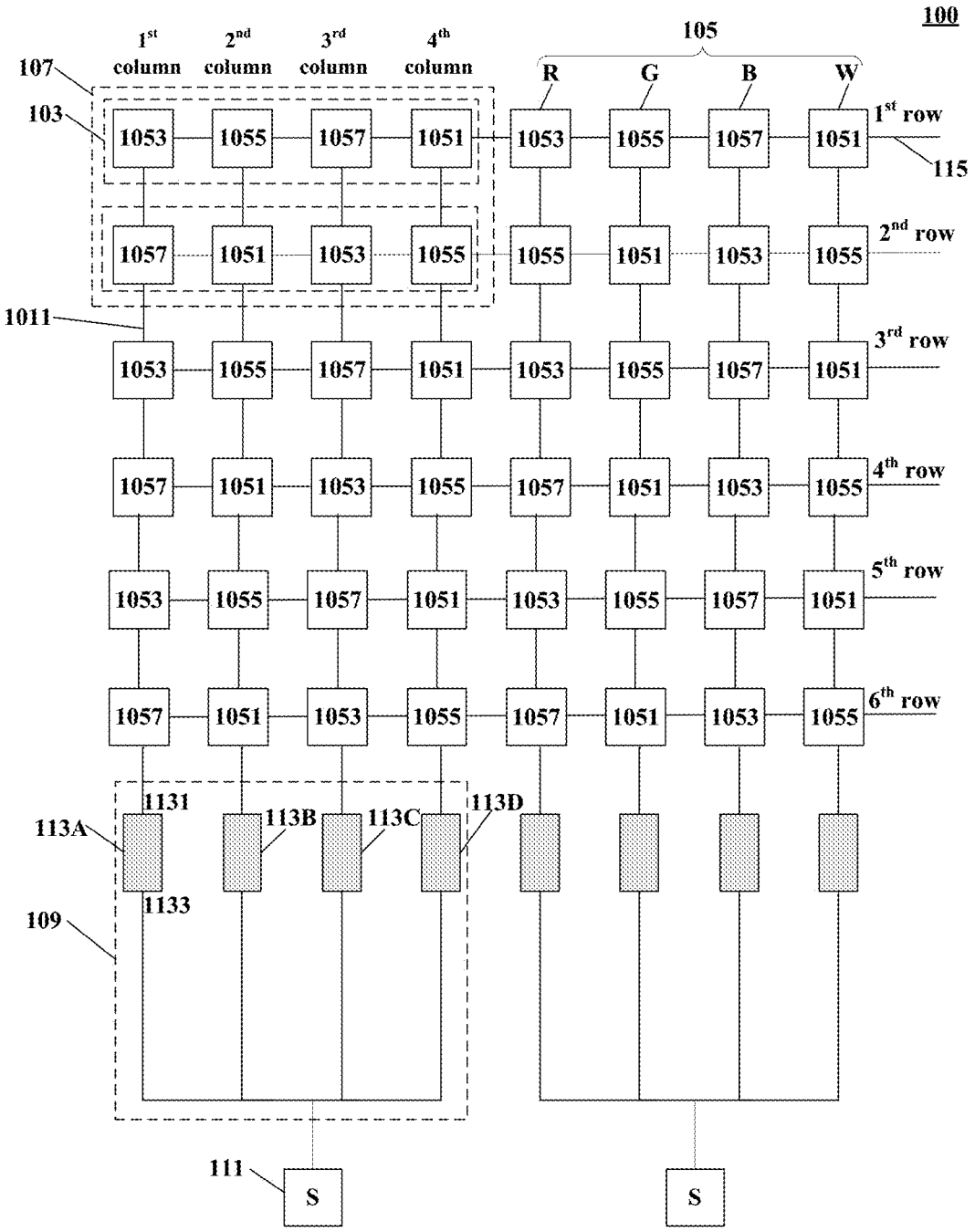
FIG. 5 is a structural schematic diagram of another display panel according to an embodiment of the present disclosure.

In an embodiment, as shown in FIG. 5, which illustrates a structural schematic diagram of another display panel according to an embodiment of the present disclosure, the display panel 100 includes four types of pixels 105 having different emitting-light colors, i.e., first color pixels 1053, second color pixels 1055, third color pixels 1057, and white pixels 1051. Two adjacent pixel units 103 in every two adjacent rows constitute one pixel repetition unit 107. The first color pixel 1053, the second color pixel 1055, the third color pixel 1057 and the white pixel 1051 are sequentially arranged in the pixel unit 103 in a first row of the pixel repetition unit 107. The third color pixel 1057, the white pixel 1051, the first color pixel 1053 and the second color pixel 1055 are sequentially arranged in the pixel unit 103 in a second row of the pixel repetition unit 107. Based on the orientation shown in FIG. 5, the first row of the pixel repetition unit 107 can be understood as the upper row, and the second row of the pixel repetition unit 107 can be understood as the lower row.

Referring to the arrangement of pixels of the embodiment shown in FIG. 5, the present embodiment exemplarily shows several driving manners as follow.

Figure 6:
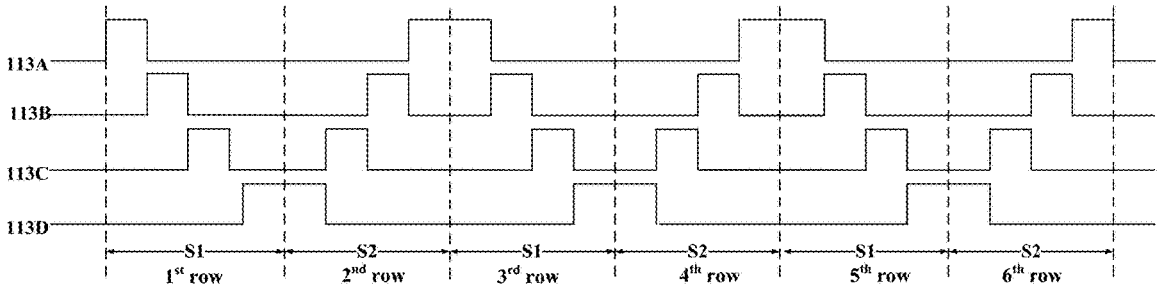
FIG. 6 is another sequence diagram of a display panel according to an embodiment of the present disclosure.

In a specific driving manner, as shown in FIG. 6, which illustrates another sequence diagram of a display panel according to an embodiment of the present disclosure, in a pixel charging sub-phase S1 of each pixel charging phase, in each driving unit 109, the switch group element 113A electrically connected to a first color pixel 1053, the switch group element 113B electrically connected to a second color pixel 1055, the switch group element 113C electrically connected to a third color pixel 1057, and the switch group element 113D electrically connected to a white pixel 1051 are sequentially switched on; and in the other pixel charging sub-phase S2 of each pixel charging phase, in each driving unit 109, the switch group element 113D electrically connected to a second color pixel 1055, the switch group element 113C electrically connected to a first color pixel 1053, the switch group element 113B electrically connected to a white pixel 1051, and the switch group element 113A electrically connected to a third color pixel 1057 are sequentially switched on. In the present embodiment, the pixel charging sub-phase S1 corresponds to the scanning of the gate line electrically connected to the first row of pixels, and the pixel charging sub-phase S2 corresponds to the scanning of the gate line electrically connected to the second row of pixels. The rest can be done in the same manner, so as to complete the display of one frame of the entire display panel. The present embodiment can be understood as a row-by-row scanning of each gate line corresponding to a row of pixels in the display panel. In one pixel charging phase, the switch group element corresponding to a firstly-charged column of pixels, such as the switch group element 113A shown in FIG. 6, receives an enable signal that changes every eight time periods, and the switch group element corresponding to a last-charged column of pixels, such as the switch group element 113D shown in FIG. 6, also receives an enable signal that changes every eight time periods. That is, the enable signal received by the switch group element corresponding to the firstly-charged column of pixels and the enable signal received by the switch group element corresponding to the last-charged column of pixels both have a cycle of 2T. When the power consumed by the switch group element each time receiving the enable signal is fixed, compared with the related art, the present embodiment can effectively reduce the power consumption due to the longer cycle of the enable signals received by the switch group elements corresponding to the firstly-charged column of pixels and the last-charged column of pixels. In addition, when the battery capacity in the display device is fixed, the standby time of the display device can become longer due to the lower power consumption of the present embodiment.

Figure 7:
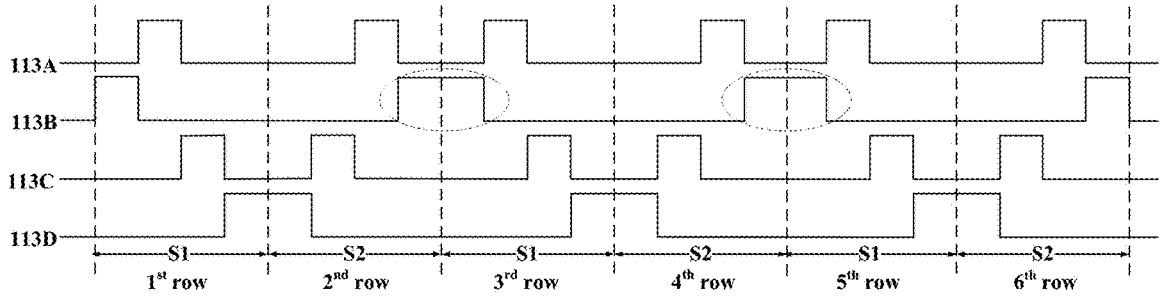
FIG. 7 is another sequence diagram of a display panel according to an embodiment of the present disclosure.

In an embodiment, as shown in FIG. 7, which illustrates another sequence diagram of a display panel according to an embodiment of the present disclosure, in a pixel charging sub-phase of each pixel charging phase, in each driving unit 109, the switch group element 113B electrically connected to the second color pixel 1055, the switch group element 113A electrically connected to the first color pixel 1053, the switch group element 113C electrically connected to the third color pixel 1057, and the switch group element 113D electrically connected to the white pixel 1051 are sequentially switched on in the first sequence; and in the other pixel charging sub-phase of each pixel charging phase, in each driving unit 109, the switch group element 113B electrically connected to the white pixel 1051, the switch group element 113A electrically connected to the third color pixel 1057, the switch group element 113C electrically connected to the first color pixel 1053, and the switch group element 113D electrically connected to the second color pixel 1055 are sequentially switched on in the second sequence. Referring to FIG. 5, taking scanning of the first gate line electrically connected to the first row of pixels and scanning of the second gate line electrically connected to the second row of pixels as an example, the pixel charging sub-phase S1 corresponds to the scanning of the first gate line electrically connected to the first row of pixels, and the pixel charging sub-phase S2 corresponds to the scanning of the second gate line electrically connected to the second row of pixels. The rest can be done in the same manner, so as to complete the display of one frame. The present embodiment also can be understood as row-by-row scanning of gate lines in the display panel. The present embodiment differs from the embodiment shown in FIG. 5 in the sequence in which the switch group elements receive the enable signals, that is, the sequence in which the switch group elements are switched on is different.

In the present embodiment, in one pixel charging phase, the switch group element corresponding to a firstly-charged column of pixels, such as the switch group element 113B shown in FIG. 7, receives an enable signal that changes every eight time periods; and the switch group element corresponding to a last-charged column of pixels, such as the switch group element 113D shown in FIG. 7, also receives an enable signal that changes every eight time periods. That is, the enable signal received by the switch group element corresponding to the firstly-charged column of pixels and the enable signal received by the switch group element corresponding to the last-charged column of pixels both have a cycle of 2T. Since the cycle of the enable signals received by the switch group elements respectively corresponding to the firstly-charged column of pixels and the last-charged column of pixels becomes longer, the present embodiment can effectively reduce the power consumption. In addition, when the battery capacity in the display device is fixed, the standby time of the display device can become longer due to the lower power consumption of the present embodiment.

Figure 8:
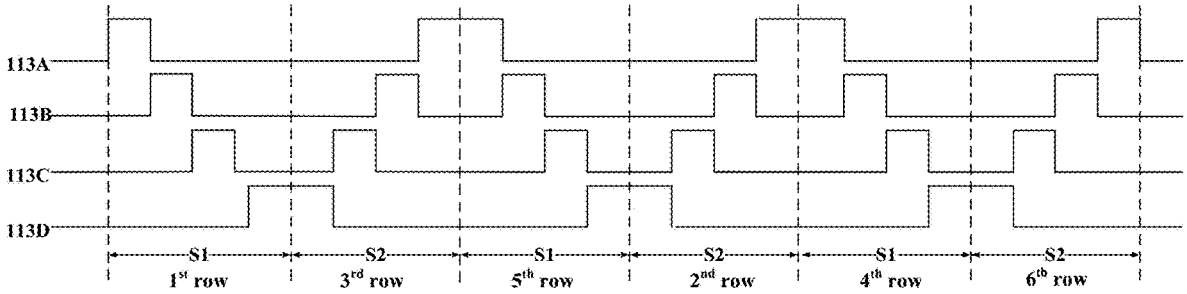
FIG. 8 is another sequence diagram of a display panel according to an embodiment of the present disclosure.

In an embodiment, as shown in FIG. 8, which illustrates another sequence diagram of a display panel according to an embodiment of the present disclosure, the driving manner shown in FIG. 8 differs from the driving manner shown in FIG. 6 in that, in the embodiment shown in FIG. 8, the odd-numbered rows of gate lines corresponding to the odd-numbered rows of pixels are scanned firstly and then the even-numbered rows of gate lines corresponding to the even-numbered rows of pixels are scanned. The specific process will be described as follows.

During the displaying of one frame, the first gate line electrically connected to the first row of pixels, the third gate line electrically connected to the third row of pixels and the fifth gate line electrically connected to the fifth row of pixels are firstly scanned. Then, the gate lines electrically connected to the even-numbered rows of pixels are scanned, i.e., the second gate line electrically connected to the second row of pixels, the fourth gate line electrically connected to the fourth row of pixels and the sixth gate line electrically connected to the sixth row of pixels are scanned. In one pixel charging phase, the scanning of the gate line corresponding to the first row of pixels corresponds to the anterior pixel charging sub-phase S1, and the scanning of the gate line corresponding to the third row of pixels corresponds to the posterior pixel charging sub-phase S2. In another pixel charging phase, the scanning of the gate line corresponding to the fifth row of pixels corresponds to the anterior pixel charging sub-phase S1, and the scanning of the gate line corresponding to the second row of pixels corresponds to the posterior pixel charging sub-phase S2. In another pixel charging phase, the scanning of the gate line corresponding to the fourth row of pixels corresponds to the anterior pixel charging sub-phase S1, and the scanning of the gate line corresponding to the sixth row of pixels corresponds to the posterior pixel charging sub-phase S2. In the time period of scanning the first gate line electrically connected to the first row of pixels, in each driving unit 109, the switch group element 113A electrically connected to a first color pixel 1053, the switch group element 113B electrically connected to a second color pixel 1055, the switch group element 113C electrically connected to a third color pixel 1057, and the switch group element 113D electrically connected to a white pixel 1051 are sequentially switched on in the first sequence, and the data signals output by the corresponding date output terminals 111 are transmitted to the corresponding pixels, thereby completing the scanning of the first gate line electrically connected to the first row of pixels. Then, in the time period of scanning the third gate line electrically connected to the third row of pixels, in each driving unit 109, the switch group element 113D electrically connected to a white pixel 1051, the switch group element 113C electrically connected to a third color pixel 1057, the switch group element 113B electrically connected to a second color pixel 1055, and the switch group element 113A electrically connected to a first color pixel 1053 are sequentially switched on in the second sequence, and the data signals output by the corresponding date output terminals 111 are transmitted to the corresponding pixels, thereby completing the scanning of the third gate line electrically connected to the third row of pixels. The rest can be done in the same manner, so as to complete the scanning process.

In the present embodiment, in each pixel charging phase, the color of the last-charged pixel in the anterior pixel charging sub-phase S1 is the same as the color of the firstly-charged pixel in the posterior pixel charging sub-phase S2. The pixels having the same color have a same charging time or charging voltage, and both are connected to a same switch group element. Therefore, the waveform of the enable signal received by the switch group element does not vary, thereby simplifying the operating process of the driving chip.

In addition, the driving method can also include: firstly scanning the even-numbered gate lines electrically connected to the even-numbered rows of pixels, and then scanning the odd-numbered gate lines electrically connected to the odd-numbered rows of pixels. The specific implementation can refer to the driving method shown in FIG. 4, and will not be described in detail herein.

Figure 9:
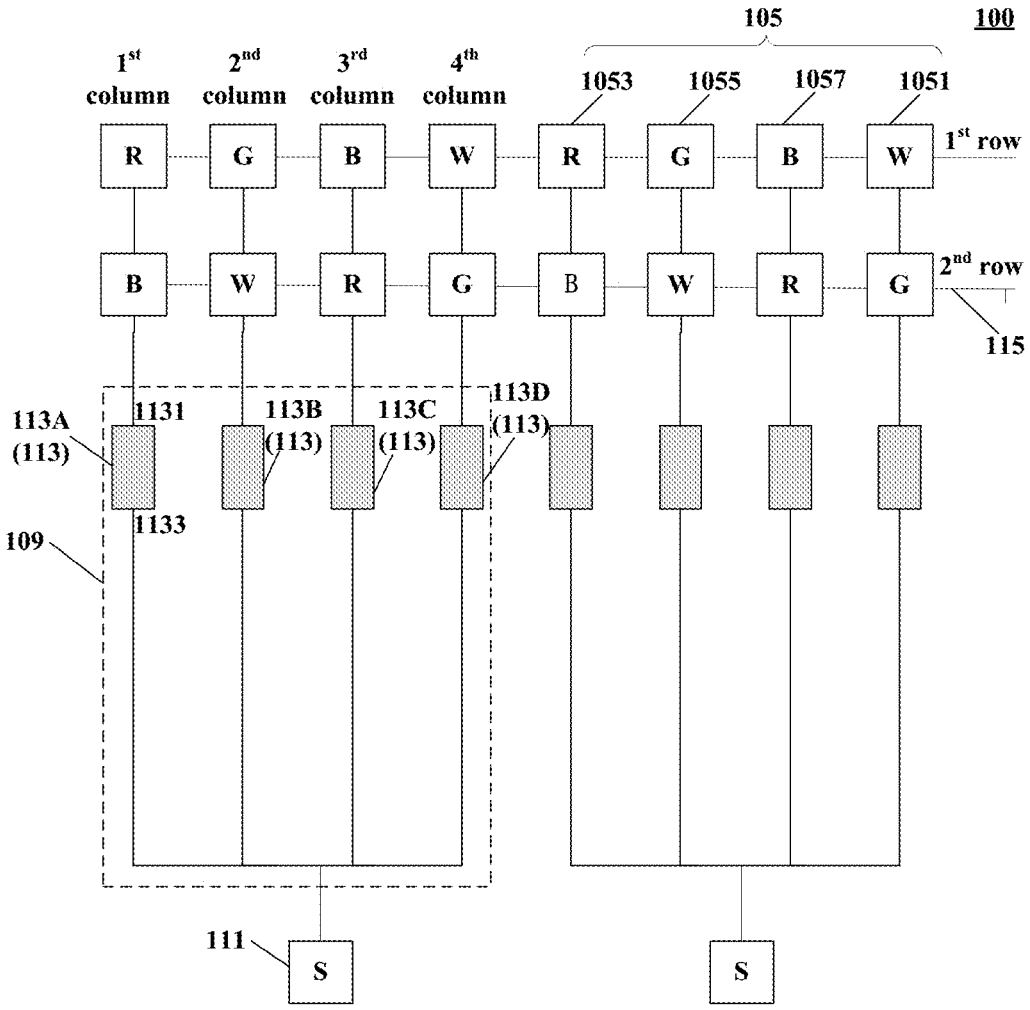
FIG. 9 is a structural schematic diagram of another display panel according to an embodiment of the present disclosure.

In another embodiment, as shown in FIG. 9, which illustrates a structural schematic diagram of another display panel according to an embodiment of the present disclosure, each of the first color pixel 1053, the second color pixel 1055 and the third color pixel 1057 is one of a red pixel R, a green pixel G and a blue pixel B. This embodiment exemplifies an arrangement of pixels. The first color pixel 1051 can be the red pixel R, the second color pixel 1055 can be the green pixel G, and the third color pixel 1057 can be the blue pixel B. The white pixel 1051 is represented by the letter W. The pixels in each odd-numbered row are arranged in a sequence of the red pixel R, the green pixel G, the blue pixel B and the white pixel W, and pixels in each even-numbered row are arranged in a sequence of the blue pixel B, the white pixel W, the red pixel R and the green pixel G. At this time, the four types of color pixels are repeatedly and alternately arranged in the row direction, so that the pixels of the same color are arranged evenly in the row direction, thereby further improving the uniformity of color mixture of the display panel and the display effect.

In addition to the beneficial effects mentioned above, referring to the driving manner of the display panel shown in FIG. 7 as well as the above pixel arrangement, in each pixel charging phase, the switch group element corresponding to the last-charged pixel in the anterior pixel charging sub-phase S1 is the same one as the switch group element corresponding to the firstly-charged pixel in the posterior pixel charging sub-phase S2. Exemplarily, the color of the last-charged pixel in the first row is a white pixel W, the color of the firstly-charged pixel in the third row is also a white pixel W, and the switch group element is a switch group element 113D.

Since the pixels of different colors may have different charging times during the charging of the pixels in the same row, the duration of the enable signal received by the switch group elements corresponding to the pixels of different colors may be different. As a result, the waveform of the received enable signal may vary. However, in this embodiment, in each pixel charging phase, the color of the last-charged pixel in the anterior pixel charging sub-phase S1 is the same as the color of the firstly-charged pixel in the posterior pixel charging sub-phase S2, pixels having the same color have a same charging time or charging voltage, and the switch group element corresponding to the last-charged pixel in the anterior pixel charging sub-phase S1 is the same one as the switch group element corresponding to the firstly-charged pixel in the posterior pixel charging sub-phase S2. Therefore, the waveform of the enable signal received by the switch group element does not vary, thereby simplifying the operating process of the driving chip and further reducing the power consumption.

In addition, referring to the driving manner of the display panel shown in FIG. 7 and the above-described arrangement of pixels, regardless of which gate line is scanned, the charging of the pixels is always done in a sequence of the green pixel G, the red pixel R, the blue pixel B and the white pixel W, i.e., the charging sequence of the pixels is the same, and the waveform of the enable signal received by the switch group elements corresponding to the pixels does not change, avoiding the change of waveform. The stable waveform can effectively simplify the operating process of the driving chip, reduce the power consumption of the driving chip, and further reduce the power consumption of the display device. In addition, the reduced power consumption of the driving chip can also extend the service life of the driving chip.

In addition, referring to the driving manner of the display panel shown in FIG. 8 and the above-described arrangement of pixels, in each pixel charging phase, the color of the last-charged pixel in the anterior pixel charging sub-phase S1 is the same as the color of the firstly-charged pixel in the posterior pixel charging sub-phase S2, pixels having the same color have a same charging time or charging voltage. Moreover, the switch group element corresponding to the last-charged pixel in the anterior pixel charging sub-phase S1 is the same one as the switch group element corresponding to the firstly-charged pixel in the posterior pixel charging sub-phase S2, thereby avoiding the waveform change of the enable single received by this switch group element, and further reducing operating process of the driving chip and reducing the power consumption of the driving chip.

Further, an opening area of the white pixel can be smaller than an opening area of the red pixel. The opening area of the white pixel can be smaller than an opening area of the green pixel. The opening area of the white pixel can be smaller than an opening area of the blue pixel. Since the light transmittance of the white pixel is higher than the light transmittance of other color pixels, the opening area of the white pixel should be smaller than the opening area of other color pixels, so that the amount of light transmission of pixels having all colors can be relatively balanced, especially avoiding a significant difference in brightness during the change of the pure color pictures.

In addition, since the opening area of the white pixel is smaller, a pixel electrode of the white pixel can be set to be smaller than the pixel electrode of other color pixels, so as to reduce the charging time of the white pixel or to reduce the voltage of the enable signal of a clock signal line corresponding to the white pixel, thereby reducing the power consumption of the display panel.

In the exemplary embodiment as shown in FIGS. 1 and 2, in one pixel charging sub-phase of each pixel charging phase, in the driving unit 109, when the switch group elements 113 corresponding to the pixel unit 103 are switched on in the first sequence, the data output terminal 111 finally outputs the data signal to the white pixel 1051. In this embodiment, in one pixel charging phase, the enable signal received by the switch group element corresponding to a firstly-charged column of pixels changes every eight time periods, and the enable signal received by the switch group element corresponding to a last-charged column of pixels also changes every eight time periods. That is, the enable signal received by the switch group element corresponding to the firstly-charged column of pixels and the enable signal received by the switch group element corresponding to the last-charged column of pixels both have a cycle of 2T. When the power consumed by the switch group element each time receiving the enable signal is constant, compared with the related art, the present embodiment can effectively reduce the power consumption due to the longer cycle of the enable signals received by the switch group elements corresponding to the firstly-charged column of pixels and the last-charged column of pixels. In addition, when the battery capacity in the display device is fixed, the standby time of the display device can become longer due to the lower power consumption of the present embodiment.

Alternatively, in the exemplary embodiment as shown in FIGS. 5 and 7, in the other pixel charging sub-phase of each pixel charging phase, in the driving unit 109, when the switch group elements 113 corresponding to the pixel unit 103 are switched on in the second sequence, the data output terminal 111 firstly outputs the data signal to the white pixel 1051. In this embodiment, in one pixel charging phase, the enable signal received by the switch group element corresponding to a firstly-charged column of pixels changes every eight time periods, and the enable signal received by the switch group element corresponding to a last-charged column of pixels also changes every eight time periods. That is, the enable signal received by the switch group element corresponding to the firstly-charged column of pixels and the enable signal received by the switch group element corresponding to the last-charged column of pixels both have a cycle of 2T. Since the cycle of the enable signals received by the switch group elements respectively corresponding to the firstly-charged column of pixels and the last-charged column of pixels becomes longer, the power consumption can be effectively reduced. In addition, when the battery capacity in the display device is fixed, the standby time of the display device can become longer due to the lower power consumption of the present embodiment.

In addition, referring to the driving manner of the display panel shown in FIG. 7 and the arrangement of pixels shown in FIG. 5, in the present embodiment, regardless of which gate line is scanned, the charging of the pixels is always done in the sequence of the green pixel G, the red pixel R, the blue pixel B and the white pixel W, i.e., the charging sequence of the pixels is the same, and the waveform of the enable signal received by the switch group elements corresponding to the pixels does not change, avoiding the change of waveform. The stable waveform can effectively simplify the operating process of the driving chip, reduce the power consumption of the driving chip, and further reduce the power consumption of the display device. In addition, the reduced power consumption of the driving chip can also extend the service life of the driving chip.

Figure 10:
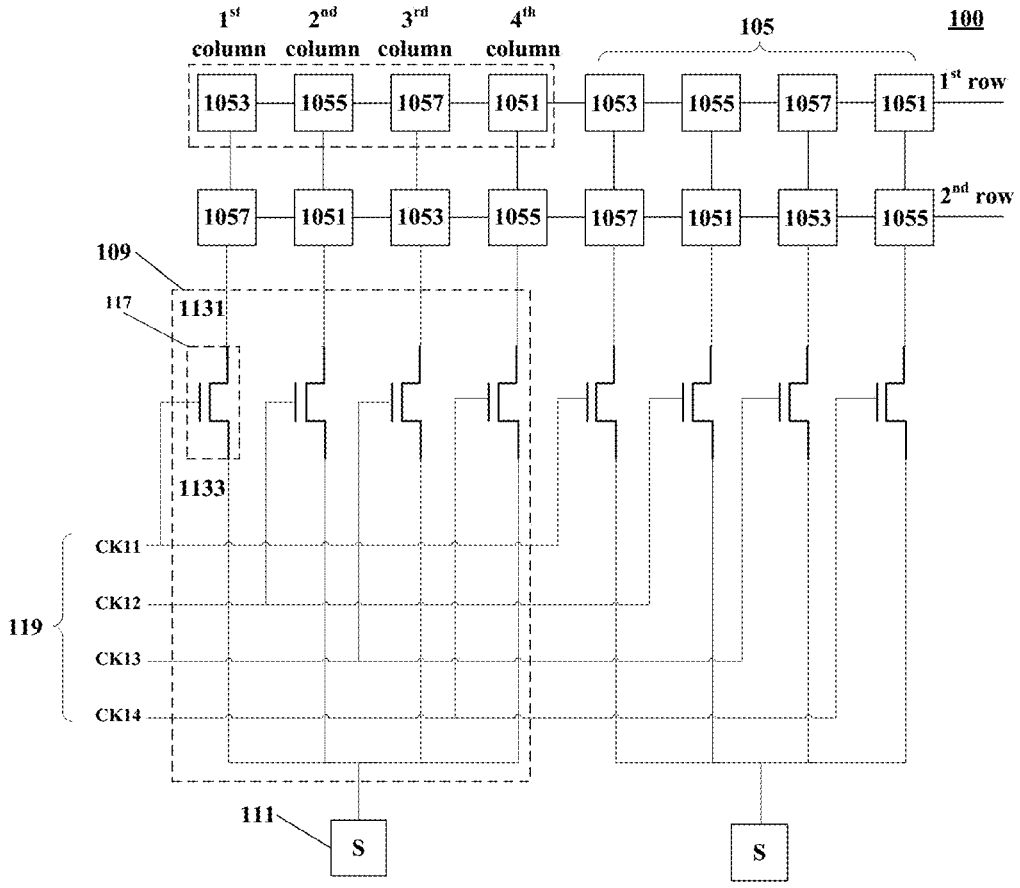
FIG. 10 is a structural schematic diagram of another display panel according to an embodiment of the present disclosure.

In an embodiment, as shown in FIG. 10, which illustrates a structural schematic diagram of another display panel according to an embodiment of the present disclosure, each switch group elements 113 includes a first thin film transistor 117. A first terminal of the first thin film transistor 117 is electrically connected to a first terminal 1131 of the switch group element, and a second terminal of the first thin film transistor 117 is electrically connected to a second terminal 1133 of the switch group element. The display panel 100 further includes at least four first clock signal lines 119, in which a $q^{th}$ first clock signal line 119 is electrically connected to a control terminal of a $q^{th}$ first thin film transistor 117 in each driving unit 109, q can be 1, 2, . . . , or M, where $1 \leq M$ and M is a positive integer. For example, as shown in FIG. 10, M=4, and q can be 1, 2, 3, 4. The first clock signal line 119 includes a clock signal line CK11, a clock signal line CK12, a clock signal line CK13 and a clock signal line CK14. The clock signal line CK11 is electrically connected to the control terminal of the first thin film transistor 117 which is electrically connected to the first column of pixels. The clock signal line CK12 is electrically connected to the control terminal of the first thin film transistor 117 which is electrically connected to the second column of pixels in the driving unit 109. The clock signal line CK13 is electrically connected to the control terminal of the first thin film transistor 117 which is electrically connected to the third column of pixels in the driving unit 109. The clock signal line CK14 is electrically connected to the control terminal of the first thin film transistor 117 which is electrically connected to the fourth column of pixels in the driving unit 109.

Figure 11:
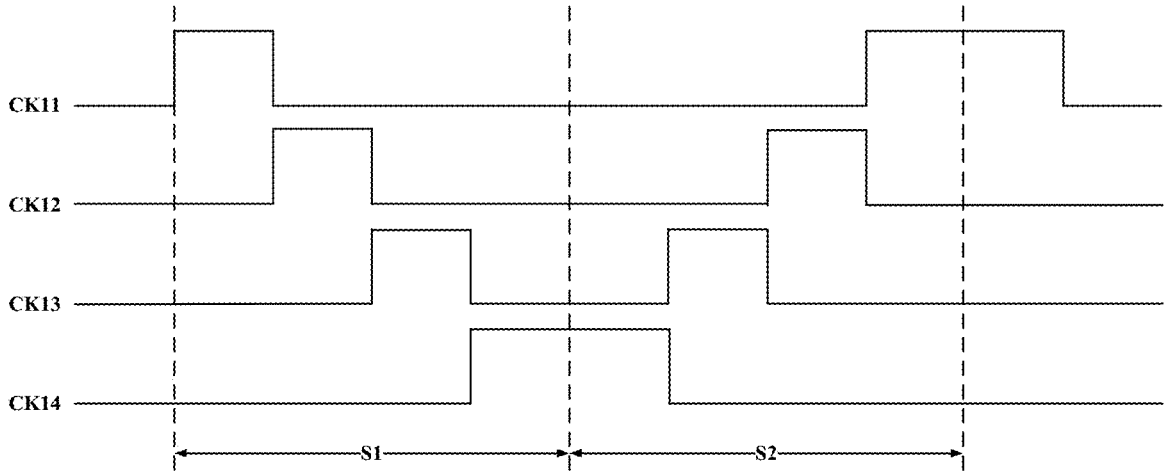
FIG. 11 is another sequence diagram of a display panel according to an embodiment of the present disclosure.

With reference to the structure shown in FIG. 10, FIG. 11 is another sequence diagram of a display panel according to an embodiment of the present disclosure. In one pixel charging sub-phase of each pixel charging phase, the at least four first clock signal lines 119 sequentially provide enable signals in a first sequence, so that the first thin film transistors 117 of each driving unit 109 are sequentially switched on in the first sequence. Here, the first sequence can be understood as that the clock signal line CK11, the clock signal line CK12, the clock signal line CK13 and the clock signal line CK14 sequentially provide the enable signals to the corresponding first thin film transistors 117. In the other pixel charging sub-phase of each pixel charging phase, the at least four first clock signal lines 119 sequentially provide enable signals in a second sequence, so that the first thin film transistors 117 of each driving unit 109 are sequentially switched on in the second sequence. Here, the second sequence can be understood as that the clock signal line CK14, the clock signal line CK13, the clock signal line CK12 and the clock signal line CK11 sequentially provide the enable signals to the corresponding first thin film transistors 117.

With reference to the structure of the display panel shown in FIG. 10, the present embodiment provides a driving method of the display panel, as shown in FIG. 11. The driving method of the display panel includes: in one pixel charging sub-phase S1 of each pixel charging phase, sequentially providing enable signals by the at least four first clock signal lines in the first sequence to switch on the first terminal and the second terminal of each of the corresponding first thin film transistors, so that data signals output by the data output terminals are transmitted to the corresponding pixels; and in the other pixel charging sub-phase S2 of each pixel charging phase, sequentially providing enable signals by at least four first clock signal lines in the second sequence to switch on the first terminal and the second terminal of each of the corresponding first thin film transistors, so that the data signals output by the data output terminals are transmitted to the corresponding pixels.

In this embodiment, in one pixel charging phase, the clock signal line corresponding to the switch group element corresponding to a firstly-charged column of pixels is turned on every eight time periods, and the clock signal line corresponding to the switch group element corresponding to a last-charged column of pixels also is turned on every eight time periods. That is, the enable signal output by the clock signal line corresponding to the switch group element corresponding to the firstly-charged column of pixels has a cycle of 2T, and the enable signal output by the clock signal line corresponding to the switch group element corresponding to the last-charged column of pixels also has a cycle of 2T. With respect to the related art that the cycle of the enable signal output by each clock signal line is T, two of the four clock signal lines in the present embodiment output the enable signals having a longer cycle, so that the power consumption can be effectively reduced. In addition, when the battery capacity in the display device is fixed, the standby time of the display device can become longer due to the lower power consumption of the present embodiment.

Further, the control terminals of the first thin film transistors 117 corresponding to the pixels in a same row having the same emitting-light color are connected to a same first clock signal line 119, so that the corresponding first thin film transistors 117 can be controlled to be switched on by controlling the same first clock signal line 119. That is, the charging of the pixels in a same row having the same emitting-light color can be completed simultaneously, which can save the charging time and can further save the scanning time of pixels in this row. For example, as shown in FIG. 10, the control terminals of the first thin film transistors 117 corresponding to two first color pixels 1053 in the first row both are electrically connected to the same first clock signal line CK11. The correspondence of other color pixels can be referred to FIG. 10, and details will not be described herein.

Figure 12:
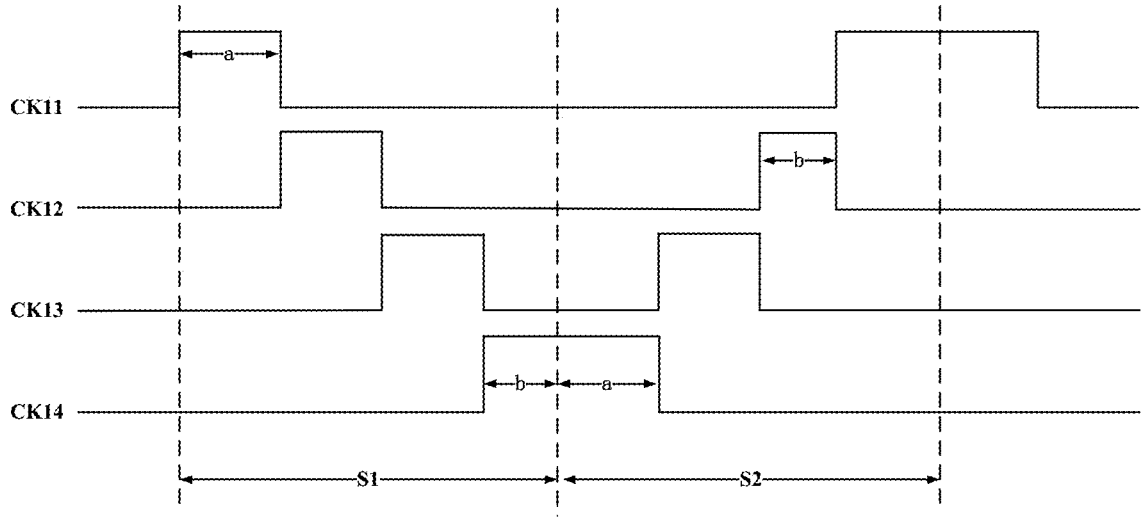
FIG. 12 is another sequence diagram of a display panel according to an embodiment of the present disclosure.

In a further embodiment, as shown in FIG. 12, which illustrates another sequence diagram of a display panel provided by an embodiment of the present disclosure, the duration of the enable signal of the first clock signal line corresponding to the white pixel is shorter than the duration of the enable signal of the first clock signal line corresponding to the pixel of any other emitting-light color. In combination with the structure of the display panel shown in FIG. 10, for example, the durations of the enable signals of the first clock signal lines 119 respectively corresponding to the first color pixel 1053, the second color pixel 1055, and the third color pixel 1057 are denoted as a, while the duration of the enable signal of the first clock signal line 119 corresponding to the white pixel 1051 is denoted as b. The opening area of the white pixel 1051 is smaller than an opening area of the first color pixel 1053, the opening area of the white pixel 1051 is smaller than an opening area of the second color pixel 1055, and the opening area of the white pixel 1051 is smaller than an opening area of the third color pixel 1057. Since the light transmittance of the white pixel is higher than the light transmittance of a pixel of any other color, the opening area of the white pixel can be set to be smaller than the opening area of a pixel of any other color, so that the amount of light transmission of pixels of all colors can be relatively balanced, especially avoiding a significant difference in brightness during the change of the pure color pictures.

In addition, since the opening area of the white pixel is smaller than the opening area of a pixel of any other color, the pixel electrode of the white pixel can be set to be smaller than the pixel electrode of a pixel of any other color. Therefore, the data signal required by the white pixel 1051 can be obtained in a shorter time period, and the charging time of the white pixel is shorter than the charging time of a pixel of any other color, i.e., a is smaller than b. In this embodiment, since the duration of the enable signal of the first clock signal line corresponding to the white pixel 105 is shorter, the power consumption of the display panel 100 can be further reduced.

Taking the white pixel 1051 in the first row in the display panel shown in FIG. 10 as an example, the process of transmitting the data signal will be briefly described as follows.

The gate line 115 corresponding to the first row of pixels receives a scanning signal. In a time period of turning-on the gate line 115 corresponding to the first row of pixels, the clock signal line CK11 is provided with an enable signal to switch on the first terminal and the second terminal of the corresponding first thin film transistor 117, so that the data signals output from the data output terminals 111 are transmitted through this first thin film transistor to the corresponding white pixel 1051, thereby completing the charging of the white pixel 1051. Since the light transmittance of the white pixel is higher than the light transmittance of a pixel of any other color, the opening area of the white pixel is set to be smaller than the opening area of a pixel of any other color. In this way, the light transmittances of the pixels of each color are relatively balanced. Since the opening area of the white pixel 1051 is relatively small, the pixel electrode of the white pixel can be correspondingly set to be smaller than the pixel electrode of a pixel of any other color. In this way, the data signal required by the white pixel 1051 can be obtained in a shorter time period, so that and the duration of the data signal required by the white pixel is shorter than the duration of the data signal required by a pixel of any other color. Therefore, the duration of the required data signal can be reduced by reducing the duration of the enable signal of the corresponding first clock signal line.

Figure 13:
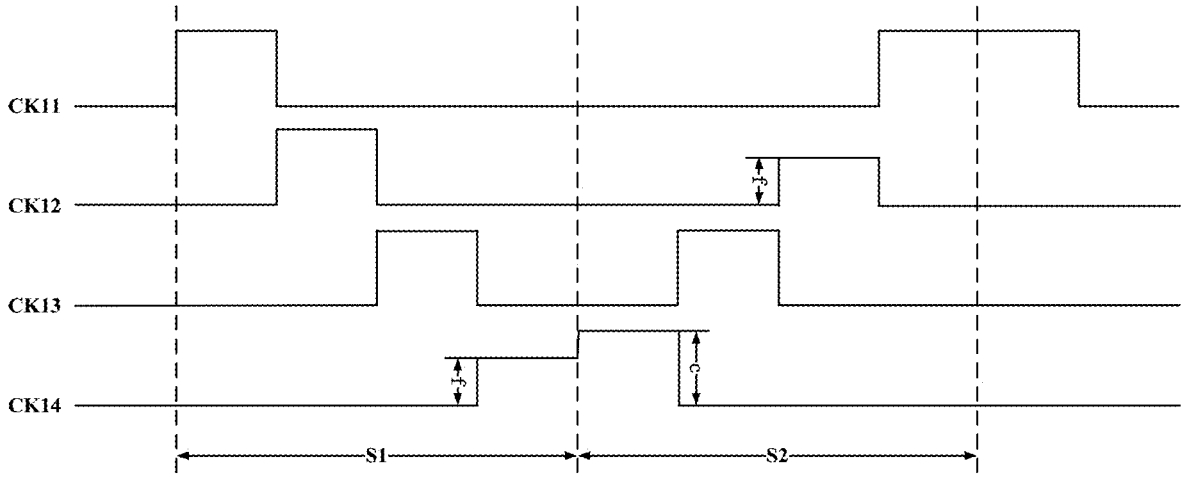
FIG. 13 is another sequence diagram of a display panel according to an embodiment of the present disclosure.

In a further embodiment, as shown in FIG. 13, which illustrates another sequence diagram of a display panel provided by an embodiment of the present disclosure, the voltage of the enable signal of the first clock signal line corresponding to the white pixel is lower than the voltage of the enable signal of the first clock signal line corresponding to a pixel of any other emitting-light color. In combination with the structure of the display panel shown in FIG. 10, for example, the voltages of the enable signal of the first clock signal lines 119 respectively corresponding to the first color pixel 1053, the second color pixel 1055, and the third color pixel 1057 is denoted as c, while the voltage of the enable signal of the first clock signal line 119 corresponding to the white pixel 1051 is denoted as f. Since the light transmittance of the white pixel is higher than the light transmittance of a pixel of any other color, the opening area of the white pixel can be set to be smaller than the opening area of a pixel of any other color, so that the light transmittances of pixels of all colors are relatively balanced. Since the opening area of the corresponding white pixel is relatively small, the pixel electrode of the white pixel can be set to be smaller than the pixel electrode of a pixel of any other color. Therefore, the power consumption of the display panel can be reduced by lowering the voltage of the enable signal of the first clock signal line 119 corresponding to the white pixel 1051. The durations of the enable signals of the first clock signal lines corresponding to the first color pixel 1053, the second color pixel 1055, the third color pixel 1057 and the white pixel 1051 are the same. In the present embodiment, since the voltage of the enable signal of the first clock signal line corresponding to the white pixel 1051 is small, the power consumption of the display panel 100 can be further reduced.

In an implementation, the first thin film transistor in this embodiment can be a P-type thin film transistor or an N-type thin film transistor.

Figure 14:
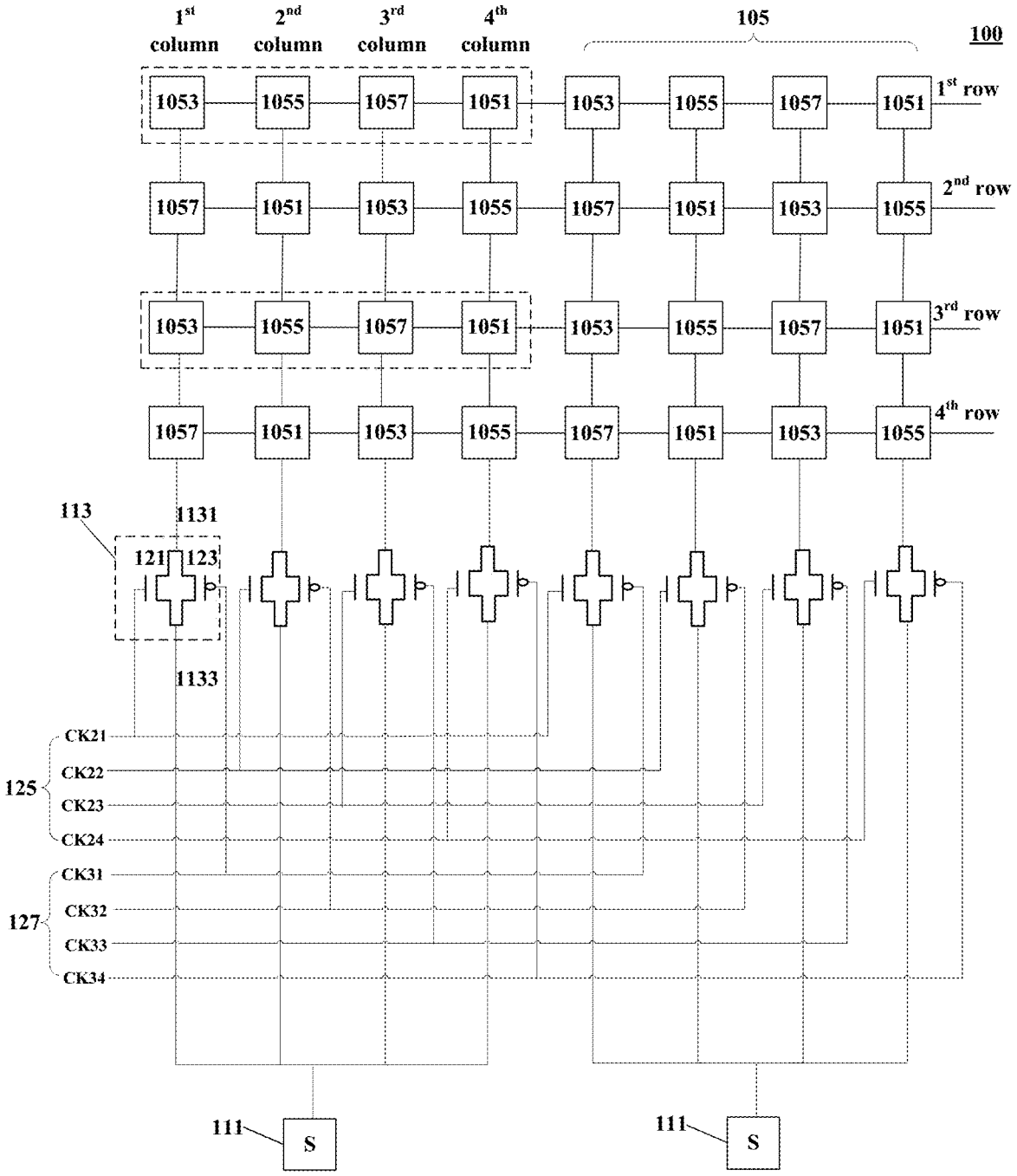
FIG. 14 is a structural schematic diagram of another display panel according to an embodiment of the present disclosure.

A specific embodiment is shown in FIG. 14, which is a structural schematic diagram of another display panel provided by an embodiment of the present disclosure. In this embodiment, each switch group element 113 includes a second thin film transistor 121 and a third thin film transistor 123. A first terminal of the second thin film transistor 121 and a first terminal of the third thin film transistor 123 are electrically connected to a first terminal 1131 of the switch group element, and a second terminal of the second thin film transistor 121 and a second terminal of the third thin film transistor 123 are electrically connected to a second terminal 1133 of the switch group element.

In this embodiment, the display panel 100 further includes at least four second clock signal lines 125, including a clock signal line CK21, a clock signal line CK22, a clock signal line CK23 and a clock signal line CK24. An $x^{th}$ second clock signal line is electrically connected to a control terminal of an $x^{th}$ second thin film transistor 121 in each driving unit, x can be 1, 2, . . . , or M, where 1≤M and M is a positive integer. In one pixel charging sub-phase of each pixel charging phase, the at least four second clock signal lines 125 sequentially provide enable signals in the first sequence, so that the second thin film transistors 121 of each driving unit are sequentially switched on in the first sequence. In the other pixel charging sub-phase of each pixel charging phase, the at least four second clock signal lines 125 sequentially provide enable signals in the second sequence, so that the second thin film transistors 121 of each driving unit are sequentially switched on in the second sequence.

In this embodiment, the display panel 100 further includes at least four third clock signal lines 127, including a clock signal line CK31, a clock signal line CK32, a clock signal line CK33 and a clock signal line CK34. A $y^{th}$ third clock signal line is electrically connected to a control terminal of a $y^{th}$ third thin film transistor in each driving unit, y can be 1, 2, . . . , or M. In one pixel charging sub-phase of each pixel charging phase, the at least four third clock signal lines 127 sequentially provide enable signals in a first sequence, so that the third thin film transistors 123 of each driving unit are sequentially switched on in the first sequence. In the other pixel charging sub-phase of each pixel charging phase, the at least four third clock signal lines 127 sequentially provide enable signals in a second sequence, so that the third thin film transistors 123 of each driving unit are sequentially switched on in the second sequence.

In this embodiment, the third clock signal lines 127 provide a switch-off signal in a period from the $1^{st}$ pixel charging sub-phase to the $(P/2)^{th}$ pixel charging sub-phase, while the second clock signal lines 125 provide the switch-off signal in a period from the $(P/2+1)^{th}$ pixel charging sub-phase to the $P^{th}$ pixel charging sub-phase.

Figure 15:
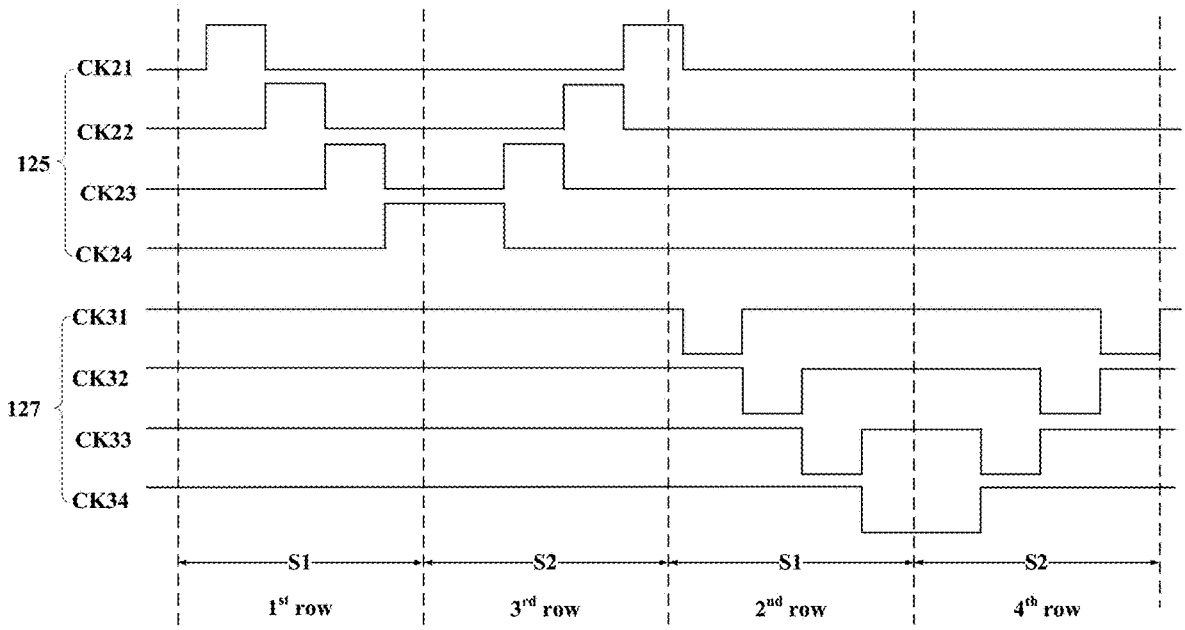
FIG. 15 is another sequence diagram of a display panel according to an embodiment of the present disclosure.

With reference to the structure of the display panel shown in FIG. 14, the present embodiment provides a driving method of the display panel, as shown in FIG. 15, which is another sequence diagram of a display panel provided by an embodiment of the present disclosure. The driving method of the display panel includes:

in one pixel charging sub-phase S1 of each pixel charging phase, sequentially providing enable signals by the at least four second clock signal lines 125 in the first sequence to switch on the second thin film transistors 121 in each driving unit in the first sequence, so that the data signals output by the data output terminals 111 are transmitted to the corresponding pixels, and in the other pixel charging sub-phase S2 of each pixel charging phase, sequentially providing enable signals by the at least four second clock signal lines 125 in the second sequence to switch on the second thin film transistors 121 in each driving unit in the second sequence, so that the data signals output by the data output terminals 111 are transmitted to the corresponding pixels;

in one pixel charging sub-phase S1 of each pixel charging phase, sequentially providing enable signals by the at least four third clock signal lines 127 in the first sequence to switch on the third thin film transistors 123 in each driving unit in the first sequence, and in the other pixel charging sub-phase S2 of each pixel charging phase, sequentially providing enable signals by the at least four third clock signal lines 127 in the second sequence to switch on the third thin film transistors 123 in each driving unit in the second sequence;

in a period from the $1^{st}$ pixel charging sub-phase to the $(P/2)^{th}$ pixel charging sub-phase, providing a switch-off signal by the third clock signal lines 127; and in a period from the $(P/2+1)^{th}$ pixel charging sub-phase to the $P^{th}$ pixel charging sub-phase, providing the switch-off signal by the second clock signal lines 125.

The above driving method will be described with reference to FIGS. 14 and 15:

Taking the display panel 100 shown in FIG. 14 as an example, there are four rows of pixels, and four times of scanning corresponding to four pixel charging sub-phases are required. In the present embodiment, in the display panel 100, the odd-numbered gate lines electrically connected to the odd-numbered rows of pixels are firstly scanned, i.e., the first gate line electrically connected to the first row of pixels and the third gate line electrically connected the third row of pixels are firstly scanned. At this time, the scanning of the first gate line corresponding to the first row of pixels and the scanning of the third gate line corresponding to the third row of pixels correspond to an anterior pixel charging phase. Then, the even-numbered gate lines electrically connected to the even-numbered rows of pixels are scanned, i.e., the scanning of the second gate line corresponding to the second row of pixels and the scanning of the fourth gate line corresponding to the fourth row of pixels correspond to a posterior pixel charging phase. The scanning of the first gate line corresponding to the first row of pixels corresponds to a pixel charging sub-phase S1 of the anterior pixel charging phase, in which the clock signal line CK21, the clock signal line CK22, the clock signal line CK23 and the clock signal line CK24 sequentially provide the enable signals to the corresponding second thin film transistors. The scanning of the third gate line corresponding to the third row of pixels corresponds to a pixel charging sub-phase S2 of the anterior pixel charging phase, in which the clock signal line CK24, the clock signal line CK23, the clock signal line CK22 and the clock signal line CK21 sequentially provide the enable signals to the corresponding second thin film transistors. The corresponding scanning of the gate lines corresponding to the even-numbered rows of pixels is the same as the scanning of the gate lines corresponding to the odd-numbered rows of pixels, as described above, which will not be repeated herein. During the scanning of the odd-numbered gate lines corresponding to the odd-numbered rows of pixels, the enable signals output by the clock signal line CK21 and the clock signal line CK24 have the cycle of 2T. Similarly, during the scanning of the even-numbered gate lines corresponding to the even-numbered rows of pixels, the enable signals output by the clock signal line CK31 and the clock signal line CK34 also have the cycle of 2T. The longer cycle can reduce the turn-on time of the clock signal line, thereby further reducing the power consumption of the clock signal line.

In addition to the beneficial effects mentioned above, referring to the driving manner of the display panel shown in FIG. 15 as well as the pixel arrangement shown in FIG. 9, in each pixel charging phase, the color of the last-charged pixel in the anterior pixel charging sub-phase S1 is the same as the color of the firstly-charged pixel in the posterior pixel charging sub-phase S2, and pixels having the same color have a same charging time. Moreover, the clock signal line corresponding to the switch group element corresponding to the last-charged pixel in the anterior pixel charging sub-phase S1 is the same one as the clock signal line corresponding to the switch group element corresponding to the firstly-charged pixel in the posterior pixel charging sub-phase S2. Therefore, the waveform of the enable signal received by the switch group element does not vary, thereby simplifying the operating process of the driving chip and further reducing the power consumption.

Figure 16:
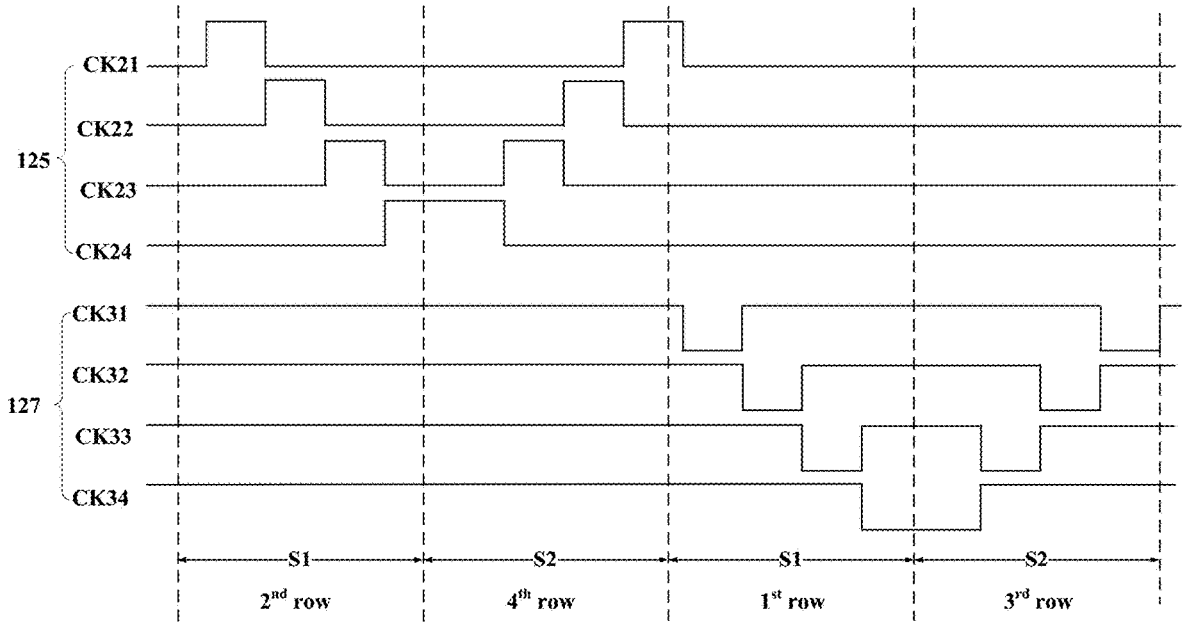
FIG. 16 is another sequence diagram of a display panel according to an embodiment of the present disclosure.

In the above embodiment, the odd-numbered gate lines electrically connected to the odd-numbered rows of pixels are firstly scanned, and the even-numbered gate lines electrically connected to the even-numbered rows of pixels are scanned. In another specific embodiment, it is also possible to scan the even-numbered gate lines electrically connected to the even-numbered rows of pixels and then scan the odd-numbered gate lines electrically connected to the odd-numbered rows of pixels. Specifically, referring to FIGS. 14 and 16, FIG. 16 is another sequence diagram of a display panel provided by an embodiment of the present disclosure. Each switch group element 113 includes a second thin film transistor 121 and a third thin film transistor 123. A first terminal of the second thin film transistor 121 and a first terminal of the third thin film transistor 123 are both connected to a first terminal 1131 of the switch group element, while a second terminal of the second thin film transistor 121 and a second terminal of the third thin film transistor 123 are both connected to a second terminal 1133 of the switch group element.

In this embodiment, the display panel 100 further includes at least four second clock signal lines 125, including a clock signal line CK21, a clock signal line CK22, a clock signal line CK23 and a clock signal line CK24. An $x^{th}$ second clock signal line 125 is electrically connected to a control terminal of an $x^{th}$ second thin film transistor 121 in each driving unit, x can be 1, 2, . . . , or M, where $1 \leq M$ and M is a positive integer. In one pixel charging sub-phase of each pixel charging phase, the at least four second clock signal lines 125 sequentially provide enable signals in a first sequence, so that the second thin film transistors 121 of each driving unit are sequentially switched on in the first sequence. In the other pixel charging sub-phase of each pixel charging phase, the at least four first clock signal lines 125 sequentially provide enable signals in a second sequence, so that the second thin film transistors 121 of each driving unit are sequentially switched on in the second sequence.

In this embodiment, the display panel further includes at least four third clock signal lines 127, including a clock signal line CK31, a clock signal line CK32, a clock signal line CK33 and a clock signal line CK34. A $y^{th}$ third clock signal line is electrically connected to a control terminal of a $y^{th}$ third thin film transistor in each driving unit, y can be 1, 2, . . . , or M. In one pixel charging sub-phase of each pixel charging phase, the at least four third clock signal lines 127 sequentially provide enable signals in a first sequence, so that the third thin film transistors 123 of each driving unit are sequentially switched on in the first sequence. In the other pixel charging sub-phase of each pixel charging phase, the at least four third clock signal lines 127 sequentially provide enable signals in a second sequence, so that the third thin film transistors 123 of each driving unit are sequentially switched on in the second sequence.

In this embodiment, the second clock signal lines 125 provide a switch-off signal in a period from the $1^{st}$ pixel charging sub-phase to the $(P/2)^{th}$ pixel charging sub-phase, while the third clock signal lines 127 provide the switch-off signal in a period from the $(P/2+1)^{th}$ pixel charging sub-phase to the $P^{th}$ pixel charging sub-phase.

With reference to the structure of the display panel shown in FIG. 14, the present embodiment provides a driving method of the display panel, as shown in FIG. 16. The driving method of the display panel includes:

in one pixel charging sub-phase of each pixel charging phase, sequentially providing enable signals by the at least four second clock signal lines in the first sequence to switch on the second thin film transistors 121 in each driving unit in the first sequence, so that the data signals output by the data output terminals are transmitted to the corresponding pixels, and in the other pixel charging sub-phase of each pixel charging phase, sequentially providing enable signals by the at least four second clock signal lines in the second sequence to switch on the second thin film transistors in each driving unit in the second sequence, so that the data signals output by the data output terminals are transmitted to the corresponding pixels;

in one pixel charging sub-phase of each pixel charging phase, sequentially providing enable signals by the at least four third clock signal lines in the first sequence to switch on the third thin film transistors in each driving unit in the first sequence, and in the other pixel charging sub-phase of each pixel charging phase, sequentially providing enable signals by the at least four third clock signal lines in the second sequence to switch on the third thin film transistors in each driving unit in the second sequence;

in a period from the $1^{st}$ pixel charging sub-phase to the $(P/2)^{th}$ pixel charging sub-phase, providing a switch-off signal by the second clock signal lines; and in a period from the $(P/2+1)^{th}$ pixel charging sub-phase to the $P^{th}$ pixel charging sub-phase, providing the switch-off signal the third clock signal lines. In the present embodiment, the even-numbered rows of pixels are firstly scanned and then the odd-numbered rows of pixels are scanned. The beneficial effects of the present embodiment can refer to the embodiment shown in FIG. 15, which will not be described herein again.

Further referring to FIG. 14, control terminals of the second thin film transistors 121 corresponding to the pixels in a same row having the same emitting-light color are connected to a same second clock signal line 125, and control terminals of the third thin film transistors 123 corresponding to the pixels in a same row having the same emitting-light color are connected to a same third clock signal line 127. The pixels in a same row having the same color can be charged simultaneously, thereby saving the charging time and further saving the scanning time of one frame.

Figure 17:
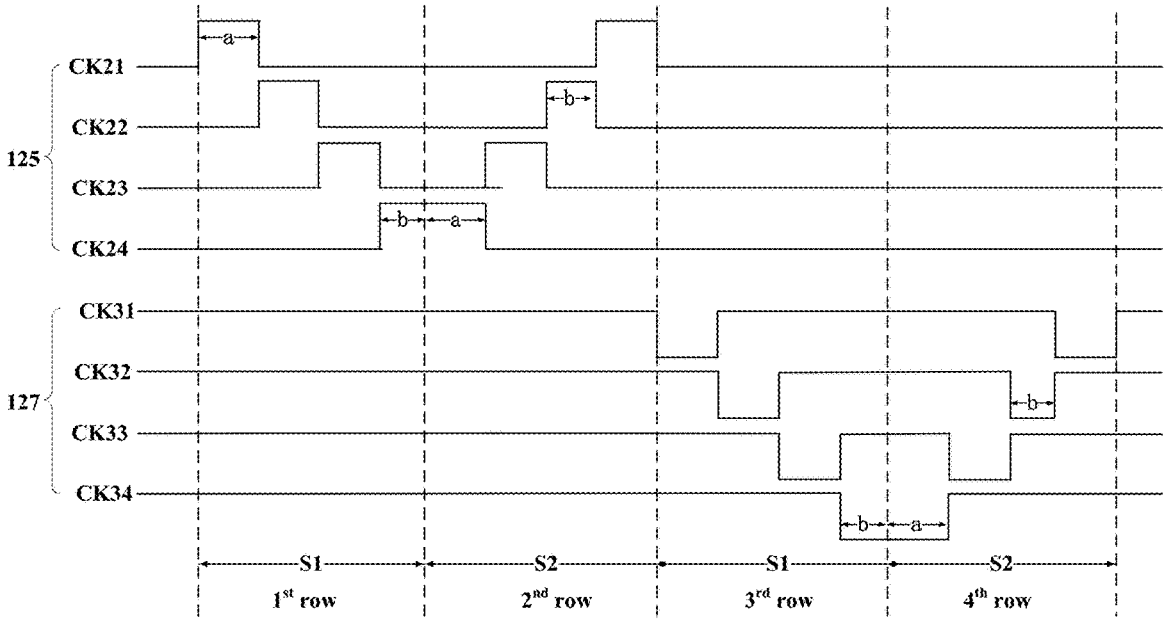
FIG. 17 is another sequence diagram of a display panel according to an embodiment of the present disclosure.

In a further embodiment, as shown in FIG. 17, which illustrates another sequence diagram of a display panel provided by an embodiment of the present disclosure, the duration of the enable signal of the second clock signal line 125 corresponding to the white pixel is denoted as a, and the duration of the enable signal of the second clock signal line corresponding to a pixel of any other emitting-light color is denoted as b, where b is smaller than a. The duration of the enable signal of the third clock signal line 127 corresponding to the white pixel is denoted as a, and the duration of the enable signal of the third clock signal line 127 corresponding to the pixel of any other emitting-light color is denoted as b, where b is smaller than a. Since the light transmittance of the white pixel is higher than the light transmittance of a pixel of any other color, the opening area of the white pixel can be set to be smaller than the opening area of a pixel of any other color, so that the light transmittance of pixels of all colors are relatively balanced. In addition, since the opening area of the white pixel 1051 is relatively small, the pixel electrode of the white pixel can be correspondingly set to be smaller than the pixel electrode of a pixel of any other color. Therefore, the data signal required by the white pixel 1051 can be obtained in a shorter time period, and the duration of the data signal required by the white pixel is shorter than the duration of the data signal required by a pixel of any other color. In this way, the duration of the required data signal can be reduced by reducing the duration of the enable signal of the corresponding first clock signal line. The detailed analysis can be referred to the related description above, which will not be described in the present embodiment again.

Figure 18:
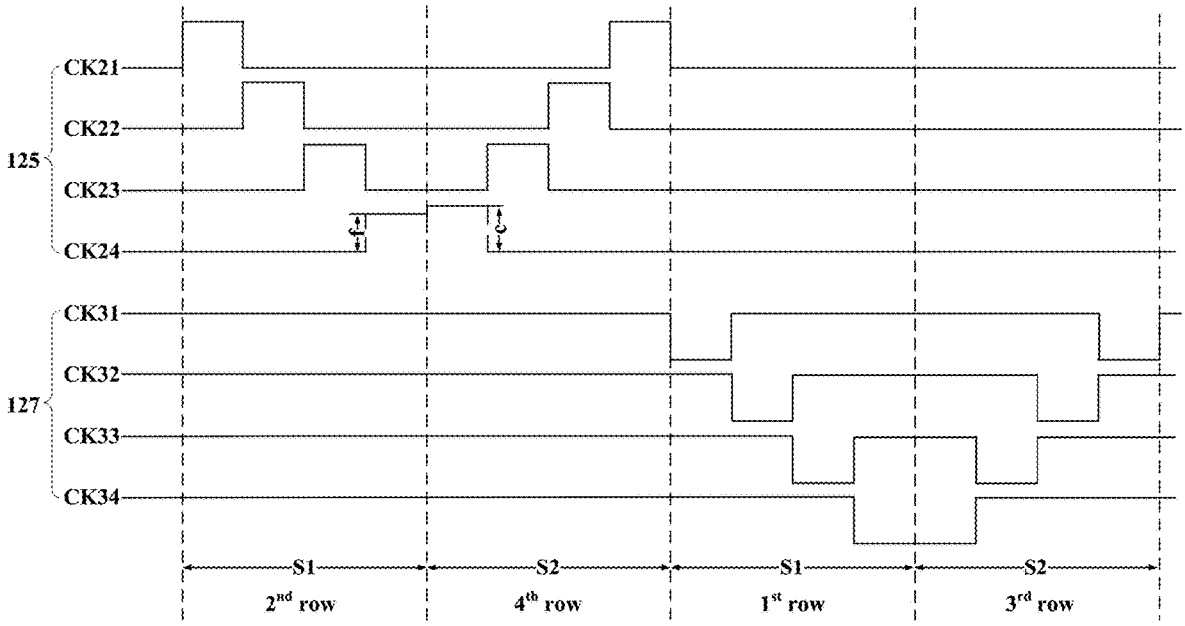
FIG. 18 is another sequence diagram of a display panel according to an embodiment of the present disclosure.

In a further embodiment, as shown in FIG. 18, which illustrates another sequence diagram of a display panel provided by an embodiment of the present disclosure, the voltage of the enable signal of the second clock signal line 125 corresponding to the white pixel is denoted as f, and the voltage of the enable signal of the second clock signal line 125 corresponding to the pixel of any other emitting-light color is denoted as c, where f is smaller than c. The voltage of the enable signal of the third clock signal line 127 corresponding to the white pixel is denoted as f, and the voltage of the enable signal of the third clock signal line corresponding to the pixel of any other emitting-light color is denoted as c, where f is smaller than c. Since the light transmittance of the white pixel is higher than the light transmittance of a pixel of any other color, the opening area of the white pixel can be set to be smaller than the opening area of a pixel of any other color, so that the light transmittances of pixels of all colors are relatively balanced. In addition, since the opening area of the white pixel 1051 is relatively small, the pixel electrode of the white pixel can be correspondingly set to be smaller than the pixel electrode of a pixel of any other color. Therefore, the voltage of the enable signal of the clock signal line corresponding to the white pixel is lower than the voltage of the enable signal of the clock signal line corresponding to the pixel of any other emitting-light color during the same charging time, so that the power consumption of the display panel can be reduced. The detailed analysis can be referred to the related description above, which will not be described in the present embodiment again.

It should be understood that, in other embodiments, on basis of any driving manner mentioned above, since the light transmittance of the white pixel is higher than the light transmittance of a pixel of any other color, the opening area of the white pixel can be set to be smaller than the opening area of a pixel of any other color, so that the light transmittances of pixels of all colors are relatively balanced. Since the opening area of the white pixel 1051 is relatively small, the pixel electrode of the white pixel can be correspondingly set to be smaller than the pixel electrode of a pixel of any other color. In this way, in addition to reducing the charging time of the white pixel, or reducing the voltage of the enable signal of the clock signal line corresponding to the white pixel, it is also possible to reduce the power consumption of the display panel by reducing the driving voltage of the white pixel.

In an implementation, the second thin film transistor in the present embodiment is a P-type thin film transistor, and the third thin film transistor is an N-type thin film transistor.

Alternatively, the second thin film transistor is an N-type thin film transistor, and the third thin film transistor is a P-type thin film transistor.

Figure 19:
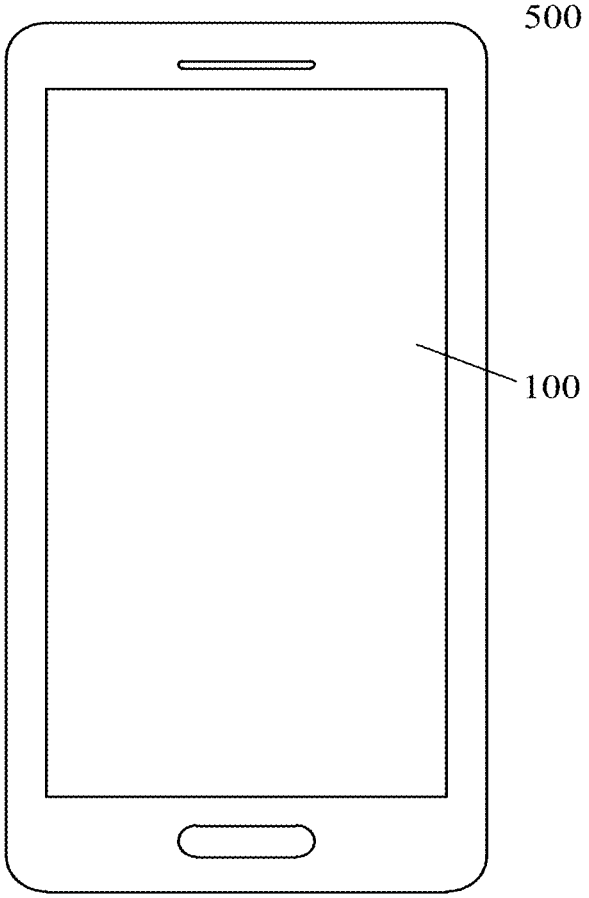
FIG. 19 is a structural schematic diagram of a display device according to an embodiment of the present disclosure.

The present disclosure provides a display device, as shown in FIG. 19, which is a structural schematic diagram of a display device provided by an embodiment of the present disclosure. The display device 500 includes the display panel 100 according to the embodiments of the present disclosure. It should be noted that FIG. 19 takes a mobile phone as an example of the display device, but the display device is not limited to the mobile phone. The display device can include but is not limited to a personal computer (PC), a personal digital assistant (PDA), a wireless handheld device, a tablet computer, an MP4 player, television or any other device having display function.

Since the display device according to this embodiment includes the above display panel, the power consumption of the driving unit can be effectively reduced, and further the power consumption of the display panel 100 can be reduced. In addition, when the power of the battery in the present embodiment is the same as the power of the battery in the related art, the battery according to the present embodiment has the longer endurance and longer standby time due to the lower power consumption of the driving unit according to the present embodiment.

It should be understood that the above embodiment are used to explain the technical solution of the present disclosure, but not intended to limit the present disclosure. Although the present disclosure is elaborated with reference to the above embodiments, those skilled in the art can modify the technical solutions or equivalently substitute parts or all of the technical features according to the above embodiments. These modifications or substitutions should not depart from the scope of the technical solutions of the present disclosure.

What is claimed is:

1. A display panel, comprising

N data line units, each of the N data line units comprising at least four data lines;

N pixel units corresponding to the N data lines arranged in each row, wherein each of the N pixel units comprises at least four types of pixels having different emitting-light colors, one of the at least four types of pixels having different emitting-light colors includes a white pixel; wherein, N pixel units corresponding to the N data line units are arranged in each row, at least four types of pixels having different emitting-light colors in each of the N pixel units correspond to at least four data lines in a corresponding data line unit in one-to-one correspondence, and pixels in a same column are electrically connected to a same data line;

N driving units electrically connected to the N data line units in one-to-one correspondence; and N data output terminals electrically connected to the N driving units in one-to-one correspondence, wherein each of the N driving units comprises at least four switch group elements corresponding to the at least four data lines in each of the N data line units in one-to-one correspondence, and wherein each switch group element of each of the N driving units has a first terminal electrically connected to a corresponding data line and a second terminal electrically connected to a corresponding data output terminal, wherein the display panel operates in P pixel charging sub-phases, P is a number of rows of pixels, every two sequential pixel charging sub-phases form one pixel charging phase of the P pixel charging sub-phase; in one pixel charging sub-phase of each pixel charging phase, at least four switch group elements of each of the N driving units are switched on in a first sequence; in the other pixel charging sub-phase of each pixel charging phase, at least four switch group elements of each of the N driving units are switched on in a second sequence; and the first sequence and the second sequence are reversed, and wherein $1 \leq P$, $1 \leq N$, and P and N are positive integers, wherein each of the at least four switch group elements comprises a first thin film transistor, and the first thin film transistor having a first terminal electrically connected to a first terminal of the switch group element and a second terminal electrically connected to a second terminal of the switch group element, wherein the display panel further comprises at least four first clock signal lines, wherein a $q^{th}$ first clock signal line is electrically connected to a control terminal of a $q^{th}$ first thin film transistor in each of the N driving units, q is 1, 2, . . . , or M, where $1 \leq M$ and M is a positive integer; and wherein in one pixel charging sub-phase of each pixel charging phase, the at least four first clock signal lines sequentially provide enable signals in the first sequence, so that first thin film transistors of each of the N driving units are sequentially switched on in the first sequence; and in the other pixel charging sub-phase of each pixel charging phase, the at least four first clock signal lines sequentially provide enable signals in the second sequence, so that first thin film transistors of each of the N driving units are sequentially switched on in the second sequence.

2. The display panel according to claim 1, wherein in one pixel charging sub-phase of each pixel charging phase, at least one of the N data output terminals finally outputs a data signal to a white pixel, or in the other pixel charging sub-phase of each pixel charging phase, at least one of the N data output terminals firstly outputs the data signal to the white pixel.

3. The display panel according to claim 1, wherein the four types of pixels having different emitting-light colors include a first color pixel, a second color pixel, a third color pixel, and a white pixel;

wherein two adjacent pixel units in every two adjacent rows constitute one pixel repetition unit, wherein the first color pixel, the second color pixel, the third color pixel and the white pixel are sequentially arranged in a pixel unit in a first row of the pixel repetition unit, and the third color pixel, the white pixel, the first color pixel and the second color pixel are sequentially arranged in a pixel unit in a second row of the pixel repetition unit.

4. The display panel according to claim 3, wherein in one pixel charging sub-phase of each pixel charging phase, in each of the N driving units, a switch group element electrically connected to the first color pixel, a switch group element electrically connected to the second color pixel, a switch group element electrically connected to the third color pixel and a switch group element electrically connected to the white pixel are sequentially switched on in the first sequence; and wherein in the other pixel charging sub-phase of each pixel charging phase, in each of the N driving unit, a switch group element electrically connected to the white pixel, a switch group element electrically connected to the third color pixel, a switch group element electrically connected to the second color pixel and a switch group element electrically connected to the first color pixel are sequentially switched on in the second sequence.

5. The display panel according to claim 3, wherein in one pixel charging sub-phase of each pixel charging phase, in each of the N driving units, a switch group element electrically connected to the second color pixel, a switch group element electrically connected to the first color pixel, a switch group element electrically connected to the third color pixel and a switch group element electrically connected to the white pixel are sequentially switched on in the first sequence; and wherein in the other pixel charging sub-phase of each pixel charging phase, in each of the N driving units, a switch group element electrically connected to the white pixel, a switch group element electrically connected to the third color pixel, a switch group element electrically connected to the first color pixel and a switch group element electrically connected to the second color pixel are sequentially switched on in the second sequence.

6. The display panel according to claim 3, wherein each of the first color pixel, the second color pixel and the third color pixel is one of a red pixel, a green pixel or a blue pixel, and wherein an opening area of the white pixel is smaller than each of an opening area of the red pixel, an opening area of the green pixel, and an opening area of the blue pixel.

7. The display panel according to claim 1, wherein control terminals of first thin film transistors corresponding to pixels having a same emitting-light color in a same row are electrically connected to a same first clock signal line, and wherein a duration of an enable signal of a first clock signal line corresponding to the white pixel is shorter than a duration of an enable signal of a first clock signal line corresponding to a pixel having any other emitting-light color, or a voltage of an enable signal of a first clock signal line corresponding to the white pixel is lower than a voltage of an enable signal of a first clock signal line corresponding to any pixel having any other emitting-light color.

8. The display panel according to claim 1, wherein the display panel further comprises P gate lines electrically connected to P rows of pixels in one-to-one correspondence, the P gate lines are configured to sequentially receive scanning signals, and when one gate line of the P gate lines is scanned, pixels in a row corresponding to the one gate line receive data signals output by the N data output terminals, and wherein during displaying of one frame of the display panel, pixels in an $i^{th}$ row receiving data signals output by the N data output terminals corresponds to an $i^{th}$ pixel charging sub-phase of the P pixel charging sub-phases, where i is 1, 2, 3, . . . , or P.

9. The display panel according to claim 1, wherein the display panel further comprises P gate lines electrically connected to P rows of pixels in one-to-one correspondence, the P gate lines are configured to receive scanning signals; and when one gate line of the P gate lines is scanned, pixels in a row corresponding to the one gate line receives data signals output by the N data output terminals, and wherein during displaying of one frame of the display panel, pixels in a $(2i-1)^{th}$ row receiving data signals output by the N data output terminals corresponds to an $i^{th}$ pixel charging sub-phase of the P pixel charging sub-phases, where i is 1, 2, 3, . . . , or P/2; and pixels in a $(2j)^{th}$ row receiving data signals output by the N data output terminals corresponds to a $(P/2+j)^{th}$ pixel charging sub-phase of the P pixel charging sub-phases, where j is 1, 2, 3, . . . , or P/2, wherein P is an even number.

10. The display panel according to claim 9, wherein each of the at least four switch group elements comprises a second thin film transistor and a third thin film transistor, a first terminal of the second thin film transistor and a first terminal of the third thin film transistor are electrically connected to a first terminal of the switch group element, and a second terminal of the second thin film transistor and a second terminal of the third thin film transistor are electrically connected to a second terminal of the switch group element, wherein the display panel further comprises at least four second clock signal lines, an $x^{th}$ second clock signal line is electrically connected to a control terminal of an $x^{th}$ second thin film transistor in each of the N driving units, x is 1, 2, . . . , or M, where 1≤M and M is a positive integer; in one pixel charging sub-phase of each pixel charging phase, the at least four second clock signal lines sequentially provide enable signals in the first sequence, so that second thin film transistors of each of the N driving units are sequentially switched on in the first sequence, and in the other pixel charging sub-phase of each pixel charging phase, the at least four second clock signal lines sequentially provide enable signals in the second sequence, so that second thin film transistors of each of the N driving units are sequentially switched on in the second sequence, wherein the display panel further comprises at least four third clock signal lines, a $y^{th}$ third clock signal line is electrically connected to a control terminal of a $y^{th}$ third thin film transistor in each of the N driving units, y is 1, 2, . . . , or M; in one pixel charging sub-phase of each pixel charging phase, the at least four third clock signal lines sequentially provide enable signals in the first sequence, so that third thin film transistors of each of the N driving units are sequentially switched on in the first sequence, and in the other pixel charging sub-phase of each pixel charging phase, the at least four third clock signal lines sequentially provide enable signals in the second sequence, so that third thin film transistors of each of the N driving units are sequentially switched on in the second sequence, and wherein the at least four third clock signal lines provide switch-off signals in a period from a $1^{st}$ pixel charging sub-phase to a $(P/2)^{th}$ pixel charging sub-phase of the P pixel charging sub-phases, and the at least four second clock signal lines provide the switch-off signal in a period from a $(P/2+1)^{th}$ pixel charging sub-phase to a $P^{th}$ pixel charging sub-phase of the P pixel charging sub-phases.

11. The display panel according to claim 1, wherein the display panel further comprises P gate lines electrically connected to P rows of pixels in one-to-one correspondence, the P gate lines sequentially receive scanning signals, and when one gate line of the gate lines is scanned, pixels in a row corresponding to the one gate line receive data signals output by the N data output terminals, wherein during displaying of one frame of the display panel, pixels in a $(2i)^{th}$ row pixels receiving data signals output by the N data output terminals corresponds to an $i^{th}$ pixel charging sub-phase of the P pixel charging sub-phases, where i is 1, 2, 3, . . . , or P/2; and pixels in a $(2j-1)^{th}$ row receiving data signals output by the N data output terminals corresponds to a $(P/2+j)^{th}$ pixel charging sub-phase of the P pixel charging sub-phases, where j is 1, 2, 3, . . . , or P/2, and wherein P is an even number.

12. The display panel according to claim 11, wherein each switch group element of the at least four switch group elements comprises a second thin film transistor and a third thin film transistor, a first terminal of the second thin film transistor and a first terminal of the third thin film transistor are electrically connected to a first terminal of the switch group element, and a second terminal of the second thin film transistor and a second terminal of the third thin film transistor are connected to a second terminal of the switch group element, wherein the display panel further comprises at least four second clock signal lines, an $x^{th}$ second clock signal line is electrically connected to a control terminal of an $x^{th}$ second thin film transistor in each of the N driving units, x is 1, 2, . . . , or M, where 1≤M and M is a positive integer; in one pixel charging sub-phase of each pixel charging phase, the at least four second clock signal lines sequentially provide enable signals in the first sequence, so that second thin film transistors of each of the N driving units are sequentially switched on in the first sequence, and in the other pixel charging sub-phase of each pixel charging phase, the at least four second clock signal lines sequentially provide enable signals in the second sequence, so that second thin film transistors of each of the N driving units are sequentially switched on in the second sequence, wherein the display panel further comprises at least four third clock signal lines, a $y^{th}$ third clock signal line is electrically connected to a control terminal of a $y^{th}$ third thin film transistor in each of the N driving units, y is 1, 2, . . . , or M; in one pixel charging sub-phase of each pixel charging phase, the at least four third clock signal lines sequentially provide enable signals in the first sequence, so that third thin film transistors of each of the N driving units are sequentially switched on in the first sequence, and in the other pixel charging sub-phase of each pixel charging phase, the at least four third clock signal lines sequentially provide enable signals in the second sequence, so that third thin film transistors of each of the N driving units are sequentially switched on in the second sequence, and wherein the at least four second clock signal lines provide switch-off signals in a period from a $1^{st}$ pixel charging sub-phase to a $(P/2)^{th}$ pixel charging sub-phase of the P pixel charging sub-phases, and the at least four third clock signal lines provide switch-offs signal in a period from a $(P/2+1)^{th}$ pixel charging sub-phase to a $P^{th}$ pixel charging sub-phase of the P pixel charging sub-phases.

13. The display panel according to claim 10, wherein control terminals of second thin film transistors corresponding to pixels having a same emitting-light color in a same row are electrically connected to a same second clock signal line, and control terminals of third thin film transistors corresponding to pixels having a same emitting-light color in a same row are electrically connected to a same third clock signal line, wherein a duration of an enable signal of a second clock signal line corresponding to the white pixel is shorter than a duration of an enable signal of a second clock signal line corresponding to a pixel having any other emitting-light color, and a duration of an enable signal of a third clock signal line corresponding to the white pixel is shorter than a duration of an enable signal of a third clock signal line corresponding to a pixel having any other emitting-light color; or wherein a voltage of an enable signal of a second clock signal line corresponding to the white pixel is lower than a voltage of an enable signal of a second clock signal line corresponding to a pixel having any other emitting-light color, and a voltage of an enable signal of a third clock signal line corresponding to the white pixel is lower than a voltage of an enable signal of a third clock signal line corresponding to the pixel having any other emitting-light color, and wherein the second thin film transistor is a P-type thin film transistor, and the third thin film transistor is an N-type thin film transistor; or the second thin film transistor is an N-type thin film transistor, and the third thin film transistor is a P-type thin film transistor.

14. The display panel according to claim 12, wherein a duration of an enable signal of a second clock signal line corresponding to the white pixel is shorter than a duration of an enable signal of a second clock signal line corresponding to a pixel having any other emitting-light color, and a duration of an enable signal of a third clock signal line corresponding to the white pixel is shorter than a duration of an enable signal of a third clock signal line corresponding to a pixel having any other emitting-light color; or wherein a voltage of an enable signal of a second clock signal line corresponding to the white pixel is lower than a voltage of an enable signal of a second clock signal line corresponding to a pixel having any other emitting-light color, and a voltage of an enable signal of a third clock signal line corresponding to the white pixel is lower than a voltage of an enable signal of a third clock signal line corresponding to the pixel having any other emitting-light color, and wherein the second thin film transistor is a P-type thin film transistor, and the third thin film transistor is an N-type thin film transistor; or the second thin film transistor is an N-type thin film transistor, and the third thin film transistor is a P-type thin film transistor.

15. A display device, comprising a display panel, wherein the display panel comprises:

N data line units, each of the N data line units comprising at least four data lines;

N pixel units corresponding to the N data lines arranged in each row, wherein each of the N pixel units comprises at least four types of pixels having different emitting-light colors, one of the at least four types of pixels having different emitting-light colors includes a white pixel; wherein N pixel units corresponding to the N data line units are arranged in each row, at least four types of pixels having different emitting-light colors in each of the N pixel units correspond to at least four data lines in a corresponding data line unit in one-to-one correspondence, and pixels in a same column are electrically connected to a same data line;

N driving units electrically connected to the N data line units in one-to-one correspondence; and N data output terminals electrically connected to the N driving units in one-to-one correspondence, wherein each of the N driving units comprises at least four switch group elements corresponding to the at least four data lines in each of the N data line units in one-to-one correspondence, and wherein each switch group element of each of the N driving units has a first terminal electrically connected to a corresponding data line and a second terminal electrically connected to a corresponding data output terminal, wherein the display panel operates in P pixel charging sub-phases, P is a number of rows of pixels, every two sequential pixel charging sub-phases form one pixel charging phase of the P pixel charging sub-phase; in one pixel charging sub-phase of each pixel charging phase, at least four switch group elements of each of the N driving units are switched on in a first sequence; in the other pixel charging sub-phase of each pixel charging phase, at least four switch group elements of each of the N driving units are switched on in a second sequence; and the first sequence and the second sequence are reversed, and wherein $1 \leq P$, $1 \leq N$, and P and N are positive integers, wherein each of the at least four switch group elements comprises a first thin film transistor, and the first thin film transistor having a first terminal electrically connected to a first terminal of the switch group element and a second terminal electrically connected to a second terminal of the switch group element, wherein the display panel further comprises at least four first clock signal lines, wherein a $q^{th}$ first clock signal line is electrically connected to a control terminal of a $q^{th}$ first thin film transistor in each of the N driving units, q is 1, 2, . . . , or M, where $1 \leq M$ and M is a positive integer; and wherein in one pixel charging sub-phase of each pixel charging phase, the at least four first clock signal lines sequentially provide enable signals in the first sequence, so that first thin film transistors of each of the N driving units are sequentially switched on in the first sequence; and in the other pixel charging sub-phase of each pixel charging phase, the at least four first clock signal lines sequentially provide enable signals in the second sequence, so that first thin film transistors of each of the N driving units are sequentially switched on in the second sequence.

16. A driving method of a display panel, wherein the display panel comprises:

N data line units, each of the N data line units comprising at least four data lines;

N pixel units corresponding to the N data lines arranged in each row, wherein each of the N pixel units comprises at least four types of pixels having different emitting-light colors, one of the at least four types of pixels having different emitting-light colors includes a white pixel; wherein N pixel units corresponding to the N data line units are arranged in each row, at least four types of pixels having different emitting-light colors in each of the N pixel units correspond to at least four data lines in a corresponding data line unit in one-to-one correspondence, and pixels in a same column are electrically connected to a same data line;

N driving units electrically connected to the N data line units in one-to-one correspondence; and N data output terminals electrically connected to the N driving units in one-to-one correspondence, wherein each of the N driving units comprises at least four switch group elements corresponding to the at least four data lines in each of the N data line units in one-to-one correspondence, and wherein each switch group element of each of the N driving units has a first terminal electrically connected to a corresponding data line and a second terminal electrically connected to a corresponding data output terminal, wherein the display panel operates in P pixel charging sub-phases, P is a number of rows of pixels, every two sequential pixel charging sub-phases form one pixel charging phase of the P pixel charging sub-phase; in one pixel charging sub-phase of each pixel charging phase, at least four switch group elements of each of the N driving units are switched on in a first sequence; in the other pixel charging sub-phase of each pixel charging phase, at least four switch group elements of each of the N driving units are switched on in a second sequence; and the first sequence and the second sequence are reversed, and wherein $1 \leq P$, $1 \leq N$, and P and N are positive integers, wherein the method comprises:

in one pixel charging sub-phase of the P pixel charging sub-phases, sequentially switching on the at least four switch group elements of each of the N driving units in the first sequence, and sequentially transmitting data signals output by the N data output terminals to corresponding pixels, and in another pixel charging sub-phase of the P pixel charging sub-phases, sequentially switching on the at least four switch group elements of each of the N driving units in the second sequence, and sequentially transmitting the data signals output by the N data output terminals to corresponding pixels, wherein each switch group element of the at least four switch group elements comprises a first thin film transistor, the first thin film transistor having a first terminal electrically connected to a first terminal of the switch group element and a second terminal electrically connected to a second terminal of the switch group element, the display panel further comprises at least four first clock signal lines electrically connected to control terminals of first thin film transistors of the at least four switch group elements of each of N driving units in one-to-one correspondence;

the driving method of the display panel comprises:

in one pixel charging sub-phase of each pixel charging phase, sequentially providing enable signals by the at least four first clock signal lines in the first sequence to switch on first terminals and second terminals of corresponding first thin film transistors, so that data signals output by the N data output terminals are transmitted to corresponding pixels, and in the other pixel charging sub-phase of each pixel charging phase, sequentially providing enable signals by the at least four first clock signal lines in the second sequence to switch on first terminals and second terminals of corresponding first thin film transistors, so that data signals output by the N data output terminals are transmitted to corresponding pixels.

17. The driving method of the display panel according to claim 16, wherein each switch group element of the at least four switch group elements comprises a second thin film transistor and a third thin film transistor, a first terminal of the second thin film transistor and a first terminal of the third thin film transistor are electrically connected to a first terminal of the switch group element, and a second terminal of the second thin film transistor and a second terminal of the third thin film transistor are electrically connected to a second terminal of the switch group element, wherein the display panel further comprises at least four second clock signal lines, an $x^{th}$ second clock signal line is electrically connected to a control terminal of an $x^{th}$ second thin film transistor in each of the N driving units, x is 1, 2, . . . , or M, where $1 \leq M$ and M is a positive integer; the display panel further comprises at least four third clock signal lines, a $y^{th}$ third clock signal line is electrically connected to a control terminal of a $y^{th}$ third thin film transistor in each of the N driving units, y is 1, 2, . . . , or M, wherein the driving method of the display panel comprises:

in one pixel charging sub-phase of each pixel charging phase, sequentially providing enable signals by the at least four second clock signal lines in the first sequence to switch on second thin film transistors in each of the N driving units in the first sequence, so that data signals output by the N data output terminals are transmitted to corresponding pixels, and in the other pixel charging sub-phase of each pixel charging phase, sequentially providing enable signals by the at least four second clock signal lines in the second sequence to switch on second thin film transistors in each of N the driving units in the second sequence, so that data signals output by the N data output terminals are transmitted to corresponding pixels;

in one pixel charging sub-phase of each pixel charging phase, sequentially providing enable signals by the at least four third clock signal lines in the first sequence to switch on third thin film transistors in each of the N driving units in the first sequence, and in the other pixel charging sub-phase of each pixel charging phase, sequentially providing enable signals by the at least four third clock signal lines in the second sequence to switch on third thin film transistors in each of the N driving units in the second sequence;

in a period from a $1^{st}$ pixel charging sub-phase to a $(P/2)^{th}$ pixel charging sub-phase of the P pixel charging sub-phases, providing switch-off signals by the at least four third clock signal lines; and in a period from a $(P/2+1)^{th}$ pixel charging sub-phase to a $P^{th}$ pixel charging sub-phase of the P pixel charging sub-phases, providing switch-off signals by the at least four second clock signal lines.

18. The driving method of the display panel according to claim 16, wherein each switch group element of the at least four switch group elements comprises a second thin film transistor and a third thin film transistor, a first terminal of the second thin film transistor and a first terminal of the third thin film transistor are electrically connected to a first terminal of the switch group element, and a second terminal of the second thin film transistor and a second terminal of the third thin film transistor are electrically connected to a second terminal of the switch group element, wherein the display panel further comprises at least four second clock signal lines, an $x^{th}$ second clock signal line is electrically connected to a control terminal of an $x^{th}$ second thin film transistor in each of the N driving units, x is 1, 2, . . . , or M, where $1 \leq M$ and M is a positive integer; wherein the display panel further comprises at least four third clock signal lines, a $y^{th}$ third clock signal line is electrically connected to a control terminal of a $y^{th}$ third thin film transistor in each of the N driving units, y is 1, 2, . . . , or M, and wherein the driving method of the display panel comprises:

in one pixel charging sub-phase of each pixel charging phase, sequentially providing enable signals by the at least four second clock signal lines in the first sequence to switch on second thin film transistors in each of the N driving units in the first sequence, so that data signals output by the N data output terminals are transmitted to corresponding pixels, and in the other pixel charging sub-phase of each pixel charging phase, sequentially providing enable signals by the at least four second clock signal lines in the second sequence to switch on second thin film transistors in each of the N driving units in the second sequence, so that data signals output by the N data output terminals are transmitted to corresponding pixels;

in one pixel charging sub-phase of each pixel charging phase, sequentially providing enable signals by the at least four third clock signal lines in the first sequence to switch on third thin film transistors in each of the N driving units in the first sequence, and in the other pixel charging sub-phase of each pixel charging phase, sequentially providing enable signals by the at least four third clock signal lines in the second sequence to switch on third thin film transistors in each of the N driving units in the second sequence;

in a period from a $1^{st}$ pixel charging sub-phase to a $(P/2)^{th}$ pixel charging sub-phase of the P pixel charging sub-phases, providing switch-off signals by the at least four second clock signal lines; and in a period from a $(P/2+1)^{th}$ pixel charging sub-phase to a $P^{th}$ pixel charging sub-phase of the P pixel charging sub-phases, providing switch-off signals by the at least four third clock signal lines.

* * * * *